US008877044B2

(12) United States Patent
Duyvesteyn et al.

(10) Patent No.: US 8,877,044 B2
(45) Date of Patent: Nov. 4, 2014

(54) METHODS FOR EXTRACTING BITUMEN FROM BITUMINOUS MATERIAL

(75) Inventors: Willem P. C. Duyvesteyn, Reno, NV (US); Mahendra Joshi, Katy, TX (US); Julian Kift, Reno, NV (US); Dominic J. Zelnik, Sparks, NV (US); Whip C. Thompson, Reno, NV (US); Cherish M. Hoffman, Reno, NV (US)

(73) Assignee: Shell Canada Energy Cheveron Canada Limited, Calgary Alberta (CA)

( * ) Notice: Subject to any disclaimer, the term of this patent is extended or adjusted under 35 U.S.C. 154(b) by 115 days.

(21) Appl. No.: 12/956,701

(22) Filed: Nov. 30, 2010

(65) Prior Publication Data

US 2011/0180459 A1 Jul. 28, 2011

Related U.S. Application Data

(63) Continuation-in-part of application No. 12/692,127, filed on Jan. 22, 2010.

(51) Int. Cl.
*C10G 1/00* (2006.01)
*C10G 1/04* (2006.01)

(52) U.S. Cl.
CPC ..... *C10G 1/045* (2013.01); *C10G 1/047* (2013.01); *C10G 1/042* (2013.01); *C10G 1/04* (2013.01)
USPC ..... 208/390; 208/391

(58) Field of Classification Search
CPC ..... C10G 1/04
USPC ..... 208/391, 390
See application file for complete search history.

(56) References Cited

U.S. PATENT DOCUMENTS

| | | | |
|---|---|---|---|
| 2,871,180 | A | 1/1959 | Lowman et al. |
| 3,131,141 | A | 4/1964 | West |
| 3,484,365 | A | 12/1969 | Pitchford |
| 3,527,692 | A | 9/1970 | Titus |
| 3,565,593 | A | 2/1971 | Moore et al. |
| 3,565,594 | A | 2/1971 | Moore |
| 3,779,902 | A | 12/1973 | Mitchell et al. |

(Continued)

FOREIGN PATENT DOCUMENTS

| | | |
|---|---|---|
| CA | 2224615 | 6/1999 |
| WO | WO 2007/102819 | 9/2007 |
| WO | WO 2011/082209 | 7/2011 |

OTHER PUBLICATIONS

International Search Report, PCT/US2010/62133, Aug. 30, 2011 (3 pp.).

(Continued)

*Primary Examiner* — Randy Boyer
*Assistant Examiner* — Juan Valencia

(57) ABSTRACT

Methods for preparing solvent-dry, stackable tailings. The method can include the steps of adding a first quantity of first solvent to a bitumen material to form a first mixture, separating a first quantity of bitumen-enriched solvent from the first mixture and thereby creating first solvent-wet tailings, adding a quantity of second solvent to first solvent-wet tailings to separate a first quantity of first solvent component from the first solvent-wet tailings and thereby producing second solvent-wet tailings, and adding a quantity of water to the second solvent-wet tailings to separate a first quantity of second solvent component from the second solvent-wet tailings and thereby forming solvent-dry, stackable tailings.

22 Claims, 6 Drawing Sheets

(56) References Cited

U.S. PATENT DOCUMENTS

| | | | | | |
|---|---|---|---|---|---|
| 4,035,282 | A | | 7/1977 | Stuchberry et al. | |
| 4,046,668 | A | | 9/1977 | Farcasiu et al. | |
| 4,054,506 | A | | 10/1977 | Hart, Jr. et al. | |
| 4,120,773 | A | | 10/1978 | Ridgway | |
| 4,120,777 | A | | 10/1978 | Globus | |
| 4,139,450 | A | | 2/1979 | Hanson et al. | |
| 4,222,873 | A | | 9/1980 | Parsons | |
| 4,224,138 | A | | 9/1980 | Kruyer | |
| 4,250,016 | A | | 2/1981 | Estes et al. | |
| 4,308,133 | A | | 12/1981 | Meyer | |
| 4,347,118 | A | | 8/1982 | Funk et al. | |
| 4,481,099 | A | * | 11/1984 | Mitchell | 208/390 |
| 4,490,259 | A | | 12/1984 | Coffing | |
| 4,512,872 | A | | 4/1985 | Chung et al. | |
| 4,589,980 | A | | 5/1986 | Keys | |
| 4,592,826 | A | | 6/1986 | Ganguli | |
| 4,596,651 | A | | 6/1986 | Wolff et al. | |
| 4,612,113 | A | | 9/1986 | Kallionen | |
| 4,676,889 | A | | 6/1987 | Hsieh et al. | |
| 4,678,561 | A | | 7/1987 | Keys | |
| 4,678,562 | A | | 7/1987 | Keys | |
| 4,702,487 | A | * | 10/1987 | Stoian et al. | 208/390 |
| 4,722,782 | A | | 2/1988 | Graham et al. | |
| 4,724,272 | A | | 2/1988 | Raniere et al. | |
| 4,744,890 | A | | 5/1988 | Miller et al. | |
| 4,846,964 | A | | 7/1989 | Scott et al. | |
| 4,859,317 | A | | 8/1989 | Shelfantook et al. | |
| 5,044,552 | A | | 9/1991 | Becker et al. | |
| 5,084,160 | A | | 1/1992 | Stewart et al. | |
| 5,143,598 | A | * | 9/1992 | Graham et al. | 208/390 |
| 5,176,802 | A | | 1/1993 | Duyvesteyn et al. | |
| 5,223,148 | A | | 6/1993 | Tipman et al. | |
| 5,236,577 | A | | 8/1993 | Tipman et al. | |
| 5,295,665 | A | | 3/1994 | Mackie | |
| 5,389,274 | A | | 2/1995 | Fernandez | |
| 5,443,158 | A | | 8/1995 | McKenney et al. | |
| 5,485,883 | A | | 1/1996 | Rippetoe et al. | |
| 5,520,799 | A | | 5/1996 | Brown et al. | |
| 5,534,136 | A | | 7/1996 | Rosenbloom | |
| 5,538,081 | A | | 7/1996 | Rippetoe et al. | |
| 5,554,301 | A | | 9/1996 | Rippetoe et al. | |
| 5,626,743 | A | | 5/1997 | Humphreys | |
| 5,626,793 | A | | 5/1997 | Reiffenrath et al. | |
| 5,670,056 | A | | 9/1997 | Yoon et al. | |
| 5,670,345 | A | | 9/1997 | Srivastava et al. | |
| 5,702,612 | A | | 12/1997 | Wang | |
| 5,728,202 | A | | 3/1998 | Nelson et al. | |
| 5,795,466 | A | | 8/1998 | Kelebek et al. | |
| 5,798,137 | A | | 8/1998 | Lord et al. | |
| 5,849,201 | A | | 12/1998 | Bradley | |
| 5,872,289 | A | | 2/1999 | Appleby et al. | |
| 5,876,592 | A | | 3/1999 | Tipman et al. | |
| 5,896,435 | A | | 4/1999 | Gautier et al. | |
| 5,961,786 | A | | 10/1999 | Freel et al. | |
| 5,968,349 | A | | 10/1999 | Duyvesteyn et al. | |
| 5,992,050 | A | | 11/1999 | Kemper et al. | |
| 6,007,709 | A | | 12/1999 | Duyvesteyn et al. | |
| 6,036,849 | A | | 3/2000 | Rippetoe et al. | |
| 6,074,558 | A | | 6/2000 | Duyvesteyn et al. | |
| 6,106,787 | A | | 8/2000 | Rippetoe | |
| 6,214,213 | B1 | | 4/2001 | Tipman et al. | |
| 6,320,148 | B1 | | 11/2001 | Yoon et al. | |
| 6,352,639 | B2 | | 3/2002 | Ito et al. | |
| 6,427,843 | B1 | | 8/2002 | Clark | |
| 6,514,310 | B2 | | 2/2003 | Allemand et al. | |
| 6,589,417 | B2 | | 7/2003 | Taciuk et al. | |
| 6,595,163 | B2 | | 7/2003 | Dumaz et al. | |
| 6,764,542 | B1 | | 7/2004 | Lackey et al. | |
| 6,768,015 | B1 | | 7/2004 | Luxem et al. | |
| 6,793,079 | B2 | | 9/2004 | Khan et al. | |
| 6,822,105 | B1 | | 11/2004 | Luxem et al. | |
| 6,827,786 | B2 | | 12/2004 | Lord | |
| 6,827,841 | B2 | | 12/2004 | Kiser et al. | |
| 6,871,743 | B2 | | 3/2005 | Yoon et al. | |
| 6,936,227 | B1 | | 8/2005 | De Souze et al. | |
| 6,965,044 | B1 | | 11/2005 | Hammond et al. | |
| 6,989,091 | B2 | | 1/2006 | Jorgensen | |
| 7,008,528 | B2 | | 3/2006 | Mitchell et al. | |
| 7,011,749 | B2 | | 3/2006 | Hayes et al. | |
| 7,018,435 | B1 | | 3/2006 | Wentinck | |
| 7,097,675 | B2 | | 8/2006 | Detering et al. | |
| 7,384,557 | B2 | | 6/2008 | Phillips et al. | |
| 7,438,807 | B2 | * | 10/2008 | Garner et al. | 210/202 |
| 7,464,756 | B2 | | 12/2008 | Gates et al. | |
| 7,585,407 | B2 | | 9/2009 | Duyvesteyn | |
| 7,588,682 | B2 | | 9/2009 | Norman | |
| 7,618,597 | B2 | | 11/2009 | Duyvesteyn | |
| 7,811,444 | B2 | | 10/2010 | Duyvesteyn et al. | |
| 7,824,453 | B2 | | 11/2010 | Duyvesteyn | |
| 7,909,989 | B2 | | 3/2011 | Duyvesteyn et al. | |
| 7,985,333 | B2 | | 7/2011 | Duyvesteyn | |
| 8,101,067 | B2 | | 1/2012 | Duyvesteyn et al. | |
| 8,257,580 | B2 | | 9/2012 | Duyvesteyn et al. | |
| 2005/0070218 | A1 | | 3/2005 | Phillips et al. | |
| 2007/0170095 | A1 | | 7/2007 | Freel et al. | |
| 2008/0156702 | A1 | | 7/2008 | Duyvesteyn | |
| 2008/0242875 | A1 | | 10/2008 | Hong et al. | |
| 2009/0090654 | A1 | | 4/2009 | Duyvesteyn et al. | |
| 2009/0145809 | A1 | | 6/2009 | Ledbetter et al. | |
| 2009/0294332 | A1 | | 12/2009 | Ryu | |
| 2009/0301937 | A1 | * | 12/2009 | Duyvesteyn et al. | 208/390 |
| 2010/0032348 | A1 | | 2/2010 | Duyvesteyn et al. | |
| 2011/0017642 | A1 | | 1/2011 | Duyvesteyn et al. | |
| 2011/0062057 | A1 | | 3/2011 | Duyvesteyn et al. | |
| 2011/0155648 | A1 | | 6/2011 | Duyvesteyn et al. | |
| 2011/0180458 | A1 | | 7/2011 | Duyvesteyn et al. | |
| 2011/0180459 | A1 | | 7/2011 | Duyvesteyn et al. | |
| 2012/0145602 | A1 | | 6/2012 | Kift et al. | |
| 2012/0145603 | A1 | | 6/2012 | Kift et al. | |
| 2012/0152809 | A1 | | 6/2012 | Kift et al. | |
| 2012/0228196 | A1 | | 9/2012 | Kift et al. | |
| 2012/0305452 | A1 | | 12/2012 | Duyvesteyn et al. | |
| 2013/0006026 | A1 | | 1/2013 | Kift et al. | |
| 2013/0025861 | A1 | | 1/2013 | Kift et al. | |
| 2013/0026076 | A1 | | 1/2013 | Kift et al. | |
| 2013/0026077 | A1 | | 1/2013 | Joshi et al. | |
| 2013/0026078 | A1 | | 1/2013 | Joshi et al. | |

OTHER PUBLICATIONS

Information about Related Patents and Patent Applications.

Biodiesel Processing, Mar. 22, 2004 (3 pp.).

Biodiesel Processing, biodiesel Handout for 2005 New Hampshire Science Tearher's Association Workshop UNH Biodiesel Group, http://www.unh.edu/p2/biodiesel, 2005 (27 pp.).

Campbell, National Biodiesel Board 2005 Annual Meeting, Marina Marriott, Ft. Lauderdale, FL, Feb. 1, 2005 (9 pp.).

Cohen et al., "Degradation of Coal by Fungi Polyporus Versicolor and Poria Monticola," Appl. Enviorn. Microbiol., 44(1):23-27, Jul. 1982 (5 pp.).

Desolventizer-Toaster, Crown Iron Works Company, PDF file created Feb. 16, 2010, (3 pp.).

Gallmetzer et al., "Efflux of Organic Acids in *Penicillium simplicissimum* is an Energy-Spilling Porcess . . . ," Microbiology 148:1143-1149, 2002 (7 pp.).

Hong et al., "A Polar-Nonpolar, Acetic Acid/Heptane, Solvent Medium for Degradation of Pyrene by Ozone," Ind. Eng. Chem. Res. 43:7710-7715, 2004 (6 pp.).

Houdaille, "Jet Pump Techinical Data—Puming Liquids," pp. 1-11, 1982 (12 pp.).

International Search Report, PCT/US10/43822, Nov. 29, 2010 (4 pp.).

International Search Report, PCT/US10/43082, Sep. 14, 2010 (11 pp.).

International Search Report and Written Opinion, PCT/US09/35552, Apr. 17, 2009 (8 pp.).

International Search Report and Written Opinion, PCT/US07/19222, Apr. 28, 2008 (8 pp.).

International Search Report, PCT/US2005/34092, Jul. 26, 2007 (6 pp.).

International Search Report, PCT/US2006/08263, Oct. 23, 2006 (5 pp.).

(56) References Cited

OTHER PUBLICATIONS

International Search Report, PCT/US2005/36728, Aug. 8, 2005 (8 pp.).
Lewis, "Liquefied Petroleum Gas," Hawley's condensed Chemical Dictionary (14th Edition), John Wiley Sons. , 2002 (1 p.).
Rogoff et al., "The Microbiology of Coal," Bureau of Mines, U.S. Dept. of the Interior, Region V, Bruceton, PA, 73:264-268, Aug. 23, 1956 (5 pp.).
Soygold, Environmental Solutions to Your Market Challenges, http://www.soygold.com/applications.htm, printed Mar. 6, 2007 (2 pp.).
Vicente et al., "A Comparative Study of Vegetable Oils for Biodiesel Production in Spain," Energy & Fuels, 20:394-398, 2006 (published on Web Nov. 8, 2005) (5 pp.).
Acetone MSDS, Sigma-Aldrich, Apr. 19, 2012 (8 pp.).
Benzene MSDS, Sigma-Aldrich, Apr. 27, 2012 (9 pp.).
Flores III, Heavy Oil Upgrading, Technology Today, Spring 2010 (6 pp.).
Toluene MSDS, Sigma-Aldrich, Apr. 24, 2012 (8 pp.).
Sinnott, R. K., Chemical Engineering Design, vol. 6, 4th ed., p. 402, Elsevier, 2005 (2 pp.).
Information about Related Patents and Patent Application.
U.S. Appl. No. 13/273,975, filed Oct. 14, 2011, Process for Extracting Bitumen and Drying the Tailings.
U.S. Appl. No. 12/964,612, filed Dec. 9, 2010, Process for Extracting Bitumen and Drying the Tailings.
U.S. Appl. No. 12/956,701, filed Nov. 30, 2010, Methods for Extracting Bitumen from Bituminous Materials.
U.S. Appl. No. 12/692,127, filed Jan. 22, 2010, Methods fro Extracting Bitumen from Bituminous Material.
U.S. Appl. No. 13/559,124, filed Jul. 26, 2012, Methods for Extracting Bitumen from Bituminous Material.
U.S. Appl. No. 13/558,041, filed Jul. 25, 2012, Methods and Apparatus for Bitumen Extraction.
U.S. Appl. No. 13/557,842, filed Jul. 25, 2012, Methods and Systems for In-Situ Extraction of Bitumen.
U.S. Appl. No. 13/557,503, filed Jul. 25, 2012, Methods for Obtaining Bitumen from Bituminous Materials.
U.S. Appl. No. 13/418,044, filed Mar. 12, 2012, Methods of Preparing Bituminous Material for Bitumen Extraction.
U.S. Appl. No. 12/956,701, filed Nov. 11, 2010, Methods for Extracting Bitumen from Bituminous Materials.
U.S. Appl. No. 12/692,127, filed Jan. 22, 2010, Methods for Extracting Bitumen from Bituminous Material.
U.S. Appl. No. 13/593,045, filed Aug. 23, 2012, Methods and Systems for Upgrading Hydrocarbon.
U.S. Appl. No. 13/584,432, filed Aug. 13, 2012, Process for Extracting Bitumen and Drying the Tailings.
U.S. Appl. No. 13/584,333, filed Aug. 13, 2012, Methods and Systems for In-Situ Extraction of Bitumen.

* cited by examiner

METHODS FOR EXTRACTING BITUMEN FROM BITUMINOUS MATERIAL

This application is a Continuation-In-Part application of U.S. application Ser. No. 12/692,127, filed Jan. 22, 2010, and herein incorporated by reference in its entirety.

BACKGROUND

Bitumen is a heavy type of crude oil that is often found in naturally occurring geological materials such as tar sands, black shale, coal formations, and weathered hydrocarbon formations contained in sandstones and carbonates. Some bitumen may be described as flammable brown or black mixtures or tarlike hydrocarbons derived naturally or by distillation from petroleum. Bitumen can be in the form of anywhere from a viscous oil to a brittle solid, including asphalt, tars, and natural mineral waxes. Substances containing bitumen may be referred to as bituminous, e.g., bituminous coal, bituminous tar, or bituminous pitch. At room temperature, the flowability of some bitumen is much like cold molasses. Bitumen may be processed to yield oil and other commercially useful products, primarily by cracking the bitumen into lighter hydrocarbon material.

As noted above, tar sands represent one of the well known sources of bitumen. Tar sands typically include bitumen, water, and mineral solids. The mineral solids can include inorganic solids such as coal, sand, and clay. Tar sand deposits can be found in many parts of the world, including North America. One of the largest North American tar sands deposits is in the Athabasca region of Alberta, Canada. In the Athabasca region, the tar sands formation can be found at the surface, although it may be buried two thousand feet below the surface overburden or more.

Tar sands deposits can be measured in barrels equivalent of oil. The Athabasca tar sands deposit has been estimated to contain the equivalent of about 1.7 to 2.3 trillion barrels of oil. Global tar sands deposits have been estimated to contain up to 4 trillion barrels of oil. By way of comparison, the proven worldwide oil reserves are estimated to be about 1.3 trillion barrels.

The bitumen content of some tar sands may vary from approximately 3 wt % to 21 wt %, with a typical content of approximately 12 wt %. Accordingly, an initial step in deriving oil and other commercially useful products from bitumen typically can require extracting the bitumen from the naturally occurring geological material. In the case of tar sands, this may include separating the bitumen from the mineral solids and other components of tar sands.

One conventional process for separating bitumen from mineral solids and other components of tar sands includes mixing the tar sands with hot water and, optionally, a process aid such as caustic soda (see, e.g., U.S. Pat. No. 1,791,797). Agitation of this mixture releases bitumen from the tar sands and allows air bubbles to attach to the released bitumen droplets. These air bubbles float to the top of the mixture and form a bitumen-enriched froth. The froth can include around 60% bitumen, 30% water, and 10% inorganic minerals. The bitumen-enriched froth is separated from the mixture, sometimes with the aid of a solvent, and further processed to isolate the bitumen product.

For example, the froth can be treated with an aliphatic (pentane-type) or an aromatic (naphtha-type) solvent to produce a clean bitumen product that can serve as a refinery upgrader feed stock. The bulk of the mineral solids can also be removed to form a tailings stream. The tailings stream can also include water, solvent, precipitated asphaltenes (in the case where the asphaltene is not soluble in the solvent used to separate the bitumen-enriched froth from the mixture), and some residual bitumen.

Tailings produced by the hot water process and/or the froth treatment process can pose several problems. Firstly, as noted above, the tailings produced by conventional methods can include solvents, precipitated asphaltenes, or residual bitumen. The bitumen and asphaltenes in a tailings stream represent unrecovered hydrocarbon that will not be processed into valuable commercial products. Accordingly, the conventional methods can result in a lower yield of hydrocarbon material, and consequently, diminished profit.

Additionally, the presence of bitumen and asphaltene in the tailings can complicate the disposal of the tailings because these materials present environmental risks. This can also be true for residual solvent included in the tailings that can be environmentally unfriendly.

The amount of tailings produced by conventional methods can also present chemical and physical problems. In some circumstances, the total volume of the tailings produced by the conventional methods may be more than the volume of mined tar sands, which means that not all of the tailings can be returned to the mined area.

The physical characteristics of the tailings can also present problems. The conventional methods sometimes utilize water and caustic as part of the process. This can result in the activation and swelling of certain clay components of a tailings stream. Accordingly, the tailings can have a sludge-like consistency that may last indefinitely. The sludge-like consistency means that the tailings are not stackable, thereby limiting the manner in which to dispose of the tailings. Often the only disposal option is to deposit the tailings in a tailings pond located outside of the mine area. These ponds can be costly to build and maintain and can be damaging to the local environment, including the local water supply. Furthermore, ponds can be damaging to the local wildlife population, such as birds, which can be caught in the oil and solvent laden tailings produced by hot-water extraction processes.

SUMMARY

Disclosed are embodiments of a method for producing solvent-dry, stackable tailings, and the solvent-dry, stackable tailings produced therefrom.

In some embodiments, a method of extracting bitumen from bituminous material is disclosed. The method includes passing a first solvent through a first quantity of bituminous material, passing a second solvent through the first quantity of bituminous material, and passing water through the first quantity of bituminous material. The second solvent can be a paraffinic solvent. The method can produce solvent-dry tailings due at least in part to the inclusion of a water wash step that is capable of effectively removing paraffinic solvent from the tailings produced during the process. The solvent-thy tailings are beneficial because they are easier to dispose of from an environmental standpoint.

In some embodiments, a method for extracting bitumen from bituminous material is disclosed. The method includes mixing first solvent with bituminous material and forming a mixture, separating the mixture into a bitumen-enriched solvent phase and a bitumen-depleted tailings phase, passing second solvent through the bitumen-depleted tailings phase, passing third solvent through the bitumen-depleted tailings phase, and passing water through the bitumen-depleted tailings phase. The third solvent can be a paraffinic solvent. The method can produce solvent-thy tailings due at least in part to the inclusion of a water wash step that is capable of effectively removing paraffinic solvent from the tailings produced during the process. The solvent-dry tailings are beneficial because they are easier to dispose of from an environmental standpoint.

In some embodiments, a method for extracting bitumen from bituminous material is disclosed. The method includes contacting a bituminous material with a first solvent and forming first solvent-wet bituminous material, contacting the first solvent-wet bituminous material with a second solvent and forming second solvent-wet bituminous material, and contacting the second solvent-wet bituminous material with water and forming a water-wet bituminous material, The second solvent can be a paraffinic solvent. The method can produce solvent-dry tailings due at least in part to the inclusion of a water wash step that is capable of effectively removing paraffinic solvent from the tailings produced during the process. The solvent-dry tailings are beneficial because they are easier to dispose of from an environmental standpoint.

It is to be understood that the foregoing is a brief summary of various aspects of some disclosed embodiments. The scope of the disclosure need not therefore include all such aspects or address or solve all issues noted in the Background above. In addition, there are other aspects of the disclosed embodiments that will become apparent as the specification proceeds.

Thus, the foregoing and other features, utilities, and advantages of the subject matter described herein will be apparent from the following more particular description of certain embodiments as illustrated in the accompanying drawings. In this regard, it is therefore also to be understood that the scope of the invention is to be determined by the claims as issued and not by whether given subject includes any or all features or aspects noted in this Summary or addresses any issues noted in the Background.

BRIEF DESCRIPTION OF THE DRAWINGS

The preferred and other embodiments are disclosed in association with the accompanying drawings in which.

DETAILED DESCRIPTION

Before describing the details of the various embodiments herein, it should be appreciated that the terms "solvent," "a solvent" and "the solvent" may include one or more than one individual solvent compounds unless expressly indicated otherwise. Mixing solvents that include more than one individual solvent compound with other materials can include mixing the individual solvent compounds simultaneously or serially unless indicated otherwise. It should also be appreciated that the term "tar sands" includes oil sands. The separations described herein can be partial, substantial or complete separations unless indicated otherwise. All percentages recited herein are volume percentages unless indicated otherwise.

Tar sands are used throughout this disclosure as a representative bitumen material. However, the methods and systems disclosed herein are not limited to processing of tar sands. Applicant believes that any bitumen material may be processed by the methods and systems disclosed herein.

Figure 1:
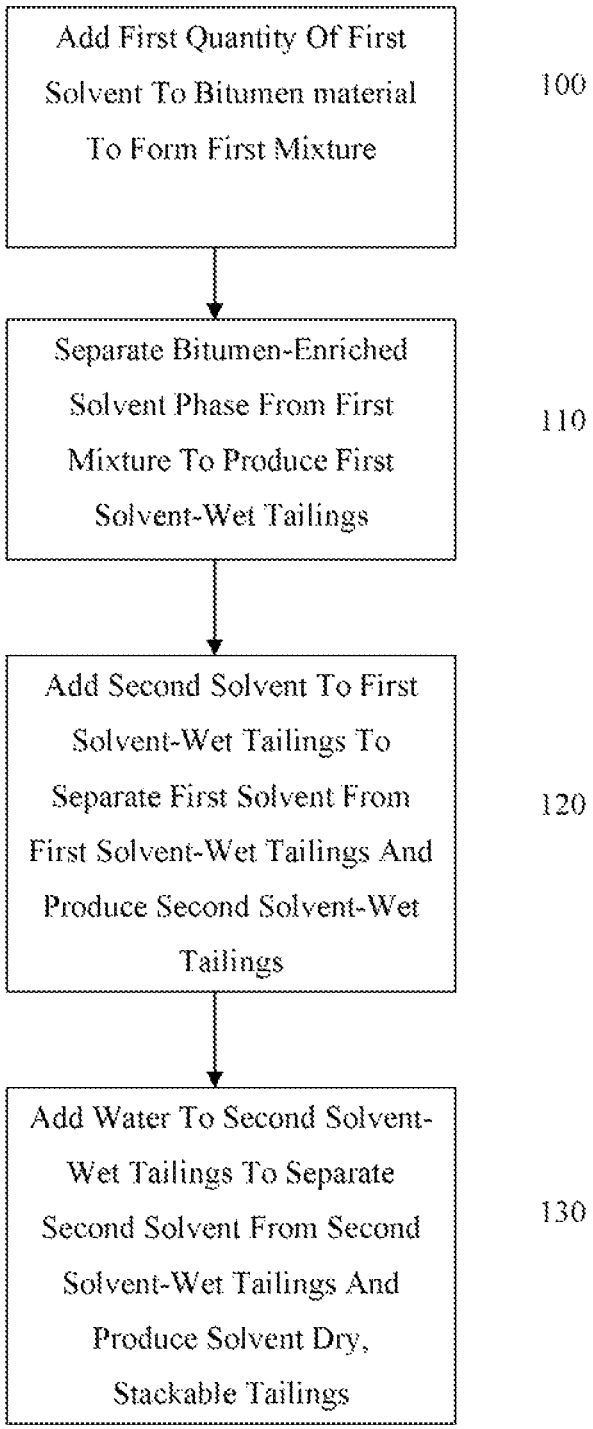
FIG. 1 is a flow chart detailing a method for producing solvent-dry, stackable tailings as disclosed herein.

With reference to FIG. 1, one embodiment of a method for producing solvent-dry, stackable tailings includes a step 100 of adding a first quantity of first solvent to a bitumen material to form a first mixture, a step 110 of separating a first quantity of bitumen-enriched solvent phase from the first mixture, a step 120 of adding a quantity of second solvent to the first solvent-wet tailings, and a step 130 of adding a quantity of water to the second solvent-wet tailings.

Step 100 of adding a first quantity of first solvent to bitumen material to form a first mixture represents a step in the solvent extraction process (also sometimes referred to as dissolution, solvation, or leaching). Solvent extraction is a process of separating a substance from a material by dissolving the substance of the material in a liquid. In this situation, the bitumen material is mixed with one or more solvents to dissolve bitumen in the solvent and thereby separate it from the other components of the bitumen material (e.g., the mineral solids of tar sands).

The first solvent used in step 100 can include a hydrocarbon solvent. Any suitable hydrocarbon solvent or mixture of hydrocarbon solvents that is capable of dissolving bitumen can be used. In some embodiments, the hydrocarbon solvent is a hydrocarbon solvent that does not result in asphaltene precipitation. The hydrocarbon solvent or mixture of hydrocarbon solvents can be economical and relatively easy to handle and store. The hydrocarbon solvent or mixture of hydrocarbon solvents may also be generally compatible with refinery operations.

In some embodiments, the first solvent is a light aromatic solvent. The light aromatic solvent can be an aromatic compound having a boiling point temperature less than about 400° C. at atmospheric pressure. In some embodiments, the light aromatic solvent used in the first mixing step is an aromatic having a boiling point temperature in the range of from about 75° C. to about 350° C. at atmospheric pressure, and more specifically, in the range of from about 100° C. to about 250° C. at atmospheric pressure. In some embodiments, the aromatic has a boiling point temperature less than 200° C.

It should be appreciated that the light aromatic solvent need not be 100% aromatic compounds. Instead, the light aromatic solvent can include a mixture of aromatic and non-aromatic compounds. For example, the first solvent can include greater than zero to about 100 wt % aromatic compounds, such as approximately 10 wt % to 100 wt % aromatic compounds, or approximately 20 wt % to 100 wt % aromatic compounds.

Any of a number of suitable aromatic compounds can be used as the first solvent. Examples of aromatic compounds that can be used as the first solvent include benzene, toluene, xylene, aromatic alcohols, and combinations and derivatives thereof. The first solvent can also include compositions, such as kerosene, diesel (including biodiesel), light gas oil, light distillate (distillate having boiling point temperature in the range of from 140° C. to 260° C.), commercial aromatic solvents such as Aromatic 100, Aromatic 150, and Aromatic 200, and/or naphtha. In some embodiments, the first solvent has a boiling point temperature of approximately 75° C. to 375° C. Naphtha, for example, is particularly effective at dissolving bitumen and is generally compatible with refinery operations.

The first solvent added into the bitumen material in step 100 need not be 100% first solvent. Other components can be included with the first solvent when it is added into the bitumen material. In some embodiments, the first solvent added into the column includes a bitumen content. First solvent including a bitumen content can be referred to as bitumen-enriched first solvent, dissolved bitumen ("disbit"), or diluted bitumen ("dilbit"). Bitumen-enriched first solvent can be obtained from bitumen extraction processes where a first solvent has already been used to extract bitumen from bitumen material. In some embodiments, the bitumen-enriched first solvent is bitumen-enriched solvent separated from the first mixture in step 110 described in greater detail below and recycled back within the method for use in step 100.

The bitumen material used in step 100 can be any material that includes bitumen. In some embodiments, the bitumen material includes any material having more than 3 wt % bitumen. Exemplary bitumen materials include, but are not limited to, tar sands, black shales, coal formations, and hydrocarbon sources contained in sandstones and carbonates. The bitumen material can be obtained by any known methods for obtaining bitumen material, such as by surface mining, underground mining, or any in situ extraction methods, such as vapor extraction (Vapex) and steam assisted gravity drainage (SAGD) extraction.

In some embodiments, the bitumen material is subjected to one or more pretreatment steps prior to being mixed with the first solvent. Any type of pretreatment step that will promote mixing between the first solvent and bitumen material and/or promote extraction of bitumen from the bitumen material can be used. In some embodiments, the pretreatment step involves heating the bitumen material. In some embodiments, the bitumen material is heated to a temperature in the range of from 30° C. to 40° C. Any manner of heating the bitumen material can be used in the pretreatment step. In some embodiments, the bitumen material is heated by adding hot water or steam to the bitumen material. Immersed heaters can also be used to heat the bitumen material.

While some embodiments include a bitumen material heating pretreatment step as described above, other embodiments specifically exclude any bitumen material heating pretreatment steps. In such embodiments, the bitumen material is mixed with the first solvent at the naturally occurring temperature of the bitumen material prior to mixing. The method can thereby eliminate the cost associated with heating the bitumen and simplify the overall method. In some embodiments the solvent is heated or retains heat from the previous recovery steps in recovering solvent from the bitumen.

The step of adding a first quantity of first solvent to the bitumen material to form a mixture can be performed as a continuous, batch, or semi-batch process. Continuous processing may typically be used in larger scale implementations. However, batch processing may result in more complete separations than continuous processing.

The first solvent can be added to the bitumen material by any suitable manner for ultimately forming a mixture of the two components. For example, the first solvent can be added to the bitumen material by mixing the two components together. The mixing of the bitumen material and the first solvent is preferably carried out to the point of dissolving most, if not all, of the bitumen contained in the bitumen material. In some embodiments, the bitumen material and the first solvent are mixed in a vessel to dissolve the bitumen and form the first mixture. The vessel can be selectively opened or closed. The vessel used for mixing can also contain mechanisms for stirring and mixing solvent and bitumen material to further promote dissolution of the bitumen in the first solvent. For example, powered mixing devices such as a rotating blade may be provided to mix the contents of the vessel. In another example, the vessel itself may be rotated to cause mixing between the bitumen material and the first solvent, such as shown in U.S. Pat. No. 5,474,397.

In certain embodiments, bitumen material and the first solvent are mixed by virtue of the manner in which the bitumen material and the first solvent are introduced into the vessel. That is to say, the first solvent is introduced into a vessel already containing bitumen material at a high velocity, thereby effectively agitating and mixing the contents of the vessel. Conversely, the bitumen material can be introduced into a vessel already containing first solvent.

The amount of the first solvent added to the bitumen material can be a sufficient amount to effectively dissolve at least a portion, or desirably all of the bitumen in the bitumen material. In some embodiments, the amount of the first solvent mixed with the bitumen material is approximately 0.5 to 3.0 times the amount of bitumen by volume contained in the bitumen material, approximately 0.6 to 2.0 times the amount of the bitumen by volume contained in the bitumen material, or preferably approximately 0.75 to 1.5 times the amount of bitumen by volume contained in the bitumen material.

It should be noted that the ratio of the first solvent to bitumen can be affected by the amount of bitumen in the bitumen material. For example, more solvent may be required for lower grade tars sands ore (e.g., 6 wt % bitumen) than for average grade tar sands ore (e.g., between 9 wt % and 14 wt % bitumen). Conversely, very high grade tar sands ore (e.g., greater than 15 wt % bitumen) may require a higher solvent to bitumen ratio again.

The first mixture of the first solvent and the bitumen material generally includes bitumen-enriched solvent, with the majority of the bitumen from the bitumen material dissolved in the bitumen-enriched solvent phase. In some embodiments, 90%, preferably 95%, and most preferably 99% or more of the bitumen in the bitumen material is dissolved in the first solvent and becomes part of the bitumen-enriched solvent.

The bitumen-enriched solvent is separated from the first mixture at step 110. Separation of the bitumen-enriched solvent from the first mixture may result in the first mixture becoming first solvent-wet tailings when a portion of the first solvent remains behind in the non-bituminous components of the first mixture after separation of bitumen-enriched solvent. Any suitable process for separating the bitumen-enriched solvent from the first mixture can be used, such as by filtering bitumen-enriched solvent from the first mixture (including but not limited to filtration via an automatic pressure filter, vacuum filtration, pressure filtration, and crossflow filtration), settling the first mixture and decanting bitumen-enriched solvent off the top of the settled mixture, by gravity or gas overpressure drainage of the bitumen-enriched solvent from the first mixture, or by displacement washing of the bitumen-enriched solvent from the first mixture. Any of these separation methods can be used alone or in combination to separate bitumen-enriched solvent from the first mixture.

In some embodiments, the bitumen-enriched solvent removed from the first mixture includes from about 5 wt % to about 50 wt % of bitumen and from about 50 wt % to about 95 wt % of the first solvent. The bitumen-enriched solvent may include little or no non-bitumen components of the bitumen material (e.g., mineral solids). The first solvent-wet tailings created by removing the bitumen-enriched solvent from the first mixture can include from about 75 wt % to about 95 wt % non-bitumen components and from about 5 wt % to about 25 wt % first solvent. The first solvent component of the first solvent-wet tailings represents first solvent mixed with the bitumen material but which is not removed from the first mixture during separation step 110. This first solvent component of the first solvent-wet tailings can have bitumen dissolved therein. Accordingly, in some embodiments, the first solvent-wet tailings includes from about 1 wt % to about 5 wt % of bitumen.

The vessel for mixing mentioned previously can function as both a mixer and a separator for separating the bitumen-enriched solvent from the first mixture. Alternatively, separate vessels can be used for mixing and separating, wherein the first mixture is transported from the mixing vessel to a separation vessel. In some embodiments, the vessel is divided into sections. One section may be used to mix the bitumen material and the first solvent and another section may be used to separate the bitumen-enriched solvent from the first mixture.

The separation of the bitumen-enriched solvent from the first mixture can be performed as a continuous, batch, or semi-batch process. Continuous processing may typically be used in larger scale implementations. However, batch processing may result in more complete separations than continuous processing.

Separation of the bitumen-enriched solvent from the first mixture by any of the above-mentioned methods can be preceded or followed by applying pressurized gas over the first mixture. Applying a pressurized gas over the first mixture can facilitate the separation of the bitumen-enriched solvent from the non-bitumen components of the first solvent-wet tailings. Bitumen-enriched solvent entrained between solid sand particles can then be removed by applying additional first solvent to the first solvent-wet tailings as described in greater detail below. The addition of additional first solvent can displace the liberated bitumen-enriched solvent from the first solvent-wet tailings by providing a driving force across a filtration element (i.e., the non-bituminous components of the bitumen material). Any suitable gas capable of displacing solvent can be used. In some embodiments, the gas is nitrogen, carbon dioxide, or steam. The gas can also be added over the first mixture in any suitable amount. In some embodiments, 1.8 $m^3$ to 10.6 $m^3$ of gas per ton of bitumen material is used. This is equivalent to a range of about 4.5 liters to 27 liters of gas per liter of bitumen material. In certain embodiments, 3.5 $ft^3$ of gas per ton of bitumen material is used.

Bitumen-enriched solvent separated during step 110 can be subjected to further processing to separate the first solvent from the bitumen. Any suitable method of separating the two components can be used. In some embodiments, the bitumen-enriched solvent is heated to a temperature above the boiling temperature of the first solvent, resulting in the first solvent evaporating off of the bitumen. The evaporated first solvent can be collected, condensed, and recycled back in the extraction process.

After bitumen-enriched solvent has been separated from the first mixture and first solvent-wet tailings have been produced as a result, a step 120 of adding a quantity of second solvent to the first solvent-wet tailings is carried out in order to remove first solvent from the first solvent-wet tailings. Addition of the second solvent can displace the first solvent component and force the first solvent out of the first solvent-wet tailings. As noted above, the first solvent-wet tailings can include from about 5 wt % to about 20 wt % of the first solvent, and it is desirable to remove this first solvent from the tailings to make the tailings more environmentally friendly. In some embodiments, the first solvent also has some bitumen dissolved therein, which will also be displaced from the solvent-wet tailings.

The second solvent can be any suitable solvent that is useful for displacing the first solvent. In some embodiments, the second solvent has a higher vapor pressure than the first solvent to enhance removal of the second solvent in subsequent processing steps. In some embodiments, the second solvent is a hydrocarbon solvent. Any suitable hydrocarbon solvent or mixture of hydrocarbon solvents that is capable of displacing the first solvent can be used. The hydrocarbon solvent or mixture of hydrocarbon solvents can preferably be economical and relatively easy to handle and store. The hydrocarbon solvent or mixture of hydrocarbon solvents may also be generally compatible with refinery operations. The hydrocarbon solvent or mixture of hydrocarbon solvents may also generally have a boiling point below that of water to facilitate solvent removal and recovery at lower energy input.

In some embodiments, the second solvent is a polar solvent. The polar solvent added to the first solvent-wet tailings can be any suitable polar solvent that is capable of displacing the first solvent. In some embodiments, the polar solvent is an oxygenated hydrocarbon. Oxygenated hydrocarbons include any hydrocarbons having an oxygenated functional group. Oxygenated hydrocarbons include alcohols, ketones, and ethers. Oxygenated hydrocarbons as used in the present application do not include alcohol ethers or glycol ethers.

Suitable alcohols for use as the polar solvent include methanol, ethanol, propanol, and butanol. The alcohol can be a primary (e.g., ethanol), secondary (e.g., isopropyl alcohol) or tertiary alcohol (e.g., tert-butyl alcohol).

As noted above, the polar solvent can also be a ketone. Generally, ketones are a type of compound that contains a carbonyl group (C═O) bonded to two other carbon atoms in the form: R1(CO)R2. Neither of the substituents R1 and R2 may be equal to hydrogen (H) (which would make the compound an aldehyde). A carbonyl carbon bonded to two carbon atoms distinguishes ketones from carboxylic acids, aldehydes, esters, amides, and other oxygen-containing compounds. The double-bond of the carbonyl group distinguishes ketones from alcohols and ethers. The simplest ketone is acetone, CH3-CO—CH3 (systematically named propanone).

When the second solvent is a polar solvent, issues can arise regarding the ability of the polar solvent to mix with first solvent (and bitumen dissolved therein) contained in the first solvent-wet tailings. Such issues may arise when the first solvent-wet tailings include a certain water content. Water may be present in the first solvent-wet tailings due to water content already present in the bitumen material when preparing the first mixture. If a sufficient amount of water is present in the first solvent-wet tailings, the polar solvent may mix with the water to form a homogenous mixture due to their common polar nature. However, once the polar solvent and water have mixed together, the mixture may then be immiscible with the first solvent due to the non-polar nature of the first solvents used in the method described herein. In such a scenario, the mixture of water and polar solvent may be repelled by the first solvent and no longer serve as a chemical solvent but only as a first solvent physical displacement agent. It may therefore be useful in some embodiments to monitor and/or control the water content of the bitumen material and first solvent-wet tailings used in the method described herein in order to avoid possible problems associated with the differences in polarity between the various solvents and displacement agents.

Adding second solvent to the first solvent-wet tailings can be carried out in any suitable manner that results in first solvent displacement from the first solvent-wet tailings. The amount of the second solvent added to the first solvent-wet tailings can be sufficient to effectively displace at least a portion, or desirably all, of the first solvent in the first solvent-wet tailings. The amount of second solvent added to the first solvent-wet tailings can be approximately 0.5 to 4 times the amount of bitumen by volume originally contained in the bitumen material.

In some embodiments, the addition of second solvent to the first solvent-wet tailings results in the removal of 95% or more of the first solvent in the first solvent-wet tailings. The first solvent can leave the first solvent-wet tailings as a first solvent-second solvent mixture. The first solvent-second solvent mixture can include from about 5 wt % to about 50 wt % first solvent and from about 50 wt % to about 95 wt % second solvent. The removal of the first solvent from the first solvent-wet tailings through the addition of second solvent can result in a quantity of second solvent not passing all the way through the first solvent-wet tailings. Accordingly, the first solvent-wet tailings can become a second solvent-wet tailings upon separation of the first solvent. In some embodiments, the second solvent-wet tailings includes from about 70 wt % to about 95 wt % non-bitumen components and from about 5 wt % to about 30 wt % second solvent.

The first solvent-second solvent mixture can be collected so that the first solvent and second solvent may be separated and reused in the extraction process. Any suitable manner of separating the first solvent from the second solvent can be used, including but not limited to, separation through heating, phase separation, and physical separation. In some embodiments, the mixture is heated to a temperature above the boiling temperature of one of the solvents but below the boiling temperature of the other solvent. In this manner, one solvent evaporates off the other solvent. The evaporated solvent can be collected, condensed, and reused in the extraction process. In some embodiments where the second solvent is a polar solvent, separation of the first solvent and the second solvent occurs naturally via phase separation or can be manipulated via control of the water content. Further descriptions separating mixtures of first solvents and polar second solvents through natural phase separation are set forth in co-pending U.S. application Ser. No. 12/560,964, herein incorporated by reference in its entirety.

As with previously described separation steps, separation of the first solvent from the first solvent-wet tailings by adding second solvent can be preceded or followed by applying pressurized gas over the first solvent-wet tailings. Applying a pressurized gas over the first solvent-wet tailings can facilitate the separation of the first solvent component of the first solvent-wet tailings from the non-bitumen components of the first solvent-wet tailings. The liberated first solvent can then be displaced from the first solvent-wet tailings by applying additional second solvent to the first solvent-wet tailings. The application of a gas overpressure can also displace first solvent from the first solvent-wet tailings by providing a driving force across a filtration element (i.e., the non-bituminous components of the first solvent-wet tailings). Any suitable gas for displacing solvent can be used. In some embodiments, the gas is nitrogen, carbon dioxide or steam. The gas can also be added over the second mixture in any suitable amount. In some embodiments, 1.8 $m^3$ to 10.6 $m^3$ of gas per ton of bitumen material is used. This is equivalent to a range of about 4.5 liters to 27 liters of gas per liter of bitumen material. In certain embodiments, 3.5 $ft^3$ of gas per ton of bitumen material is used.

In step 130, water is added to the second solvent-wet tailings to remove second solvent from the second solvent-wet tailings and thereby produce solvent-dry, stackable tailings. The addition of water to the second solvent-wet tailings can serve to displace the second solvent from the second solvent-wet tailings and force the second solvent out of the second solvent-wet tailings. In some embodiments, the addition of water results in the removal of 95 wt % or more of the second solvent from the second solvent-wet tailings.

Any manner of adding water to the second solvent-wet tailings that results in displacement of second solvent from the second solvent-wet tailings can be used. In some embodiments, the manner in which the water is added to the second solvent-wet tailings is similar or identical to the manner in which the first solvent is added to the first mixture or the second solvent is added to the first solvent wet tailings.

In some embodiments, water with an elevated temperature (i.e., above room temperature) or steam is used to displace second solvent from second-solvent wet tailings. Water with an elevated temperature can preferably be at a temperature greater than the boiling point temperature of the second solvent. When water at an elevated temperature or steam is used, the introduction of the water or steam into the second solvent-wet tailings can serve to both displace the second solvent and remove second solvent via evaporation. For example, steam may rapidly condense once introduced into the second solvent-wet tailings and transfer heat to the second solvent, resulting in second solvent evaporation. Water at an elevated temperature can be added with the second solvent-wet tailings in the same manner as water at room temperature. Steam can be injected into the second solvent-wet tailings. Any manner for injecting steam into the second solvent-wet tailings can be used. In some embodiments, injection lines are inserted into the second solvent-wet tailings through which steam can be injected into the second solvent-wet tailings.

The amount of the water or steam added to the second solvent-wet tailings can be sufficient to effectively displace and/or evaporate at least a portion, or desirably all, of the second solvent in the second solvent-wet tailings. The amount of water added to the second solvent-wet tailings can be approximately 0.5 to 4 times the amount of bitumen by volume originally contained in the bitumen material. The amount of steam added to the second solvent-wet tailings can be approximately less than or equal to 2 times the amount of bitumen by volume originally contained in the bitumen material.

In some embodiments, the water is added in two or more stages, with the water being in the same or different phases for each stage. For example, in some embodiments, a first stage addition of water includes the addition of water in a liquid phase, and a second stage addition of water includes the addition of steam. When water in a liquid phase is used for any stage, the water can be at any suitable temperature, including water at elevated temperatures.

In embodiments where polar solvents are used as the second solvent, the step 130 of adding water to the second solvent-wet tailings can be especially effective at removal of the polar second solvent. This may be due to the miscibility of many polar solvents in water. The water can form a homogenous mixture with the polar solvent as it passes through the second-solvent wet tailings, resulting in effective removal of second solvent.

Water used to displace second solvent from the second solvent-wet tailings can exit the second solvent-wet tailings in a mixture with displaced second solvent. The mixture of water and second solvent can be collected and separated so that the water and second solvent can be reused in the extraction method. Any suitable method for separating the water and second solvent can be used. In some embodiments, the water and second solvent are separated based on differences in boiling temperatures. In embodiments where certain polar solvents (such as methanol) are used, no azeotrope between the polar solvent and water exists, thus making the separation of the water and polar solvent by heating a viable mechanism for separation. If azeotropes are formed, the azeotropic solution can be used as a solvent for a washing step performed after completion of the washing step with the second solvent but prior to the washing step with water. Polar solvents (such as methanol) and water can also be separated using membrane-based pervaporation, which is an energy efficient combination of membrane permeation and evaporation.

In some embodiments, the water and second solvent exiting the second solvent-wet tailings may also include residual first solvent. The residual first solvent can be included with the second solvent and water in situations where the addition of second solvent to the first solvent-wet tailings does not fully displace all of the first solvent from the tailings. In some embodiments, the residual first solvent is disbit. In embodiments where the second solvent is a polar solvent, the mixture of water, polar solvent, and first solvent exiting the second solvent-wet tailings can phase separate due to the common polarity of the water and polar solvent and the non-polar nature of the first solvent. More specifically, the polar solvent will be miscible in the water and form a homogenous mixture, while the first solvent will be repelled from the homogenous mixture due to the differences in polarity. In such a scenario, the first solvent component of the mixture exiting the second solvent-wet tailings can be separated from the homogenous mixture of water and polar solvent using relatively simple and inexpensive separation methods (e.g., decanting), as opposed to a more complicated and expensive separation process (e.g., distillation) that is traditionally required when phase separation has not occurred.

The solvent-dry, stackable tailings resulting from removal of the second solvent from the second solvent-wet tailings generally include inorganic solids, such as sand and clay, water, and little to no first and second solvent. As used herein, the term "solvent-thy" means containing less than 0.1 wt % total solvent. As used herein, the term "stackable" means having a water content of from about 2 wt % to about 15 wt %. This range of water content can create damp tailings that will not produce dust when transporting or depositing the tailings. This range of water content can also provide stackable tailings that will not flow like dry sand, and therefore have the ability to be retained within an area without the need for retaining structures (e.g., a tailings pond). This range of water content can also provide tailings that are not so wet as to be sludge-like or liquid-like. The solvent-dry, stackable tailings produced by the above described method can also include less than 2 wt % bitumen.

Generally speaking, the above-described process can be considered advantageous over the previously known hot water bitumen extraction process because water is used to remove solvent rather than to extract bitumen from bitumen material. In Applicant's experience, water displaces solvent more easily than it extracts bitumen. Additionally, avoiding the use of water to extract bitumen can mitigate or eliminate many of the problems discussed in greater detail above.

In some embodiments, the above, described method may be carried with the use of a plate and frame-type filter press. After performing step 100 of mixing first solvent with bitumen material, the first mixture may be loaded into a plate and frame-type filter press, at which point the separation and addition steps 110, 120, and 130 may be carried out.

The plate and frame-type filter press may be any suitable type of plate and frame-type filter press, including both vertical and horizontal plate and frame-type filter presses. An exemplary vertical plate and frame-type filter press suitable for use in this method is described in U.S. Pat. No. 4,222,873. An exemplary horizontal plate and frame-type filter press suitable for use in this method is described in U.S. Pat. No. 6,521,135. Generally, the first mixture may be pumped into frame chamber located between two filter plates. The first mixture fills the frame chamber and, as the frame chamber becomes fully occupied by the first mixture, separation step 110 takes place as liquid bitumen-enriched solvent migrates out of the frame chamber through the filter cloths of each filter plate. The solid material of the first mixture remains behind in the frame chamber.

Separation of the bitumen-enriched solvent from the first mixture may also take place by adding additional first solvent into the filter press after loading the first mixture into the frame chamber. The additional first solvent pumped into the frame chamber may serve to displace bitumen-enriched solvent from the frame chamber and through the filter cloths. Any suitable amount of additional first solvent that will displace bitumen-enriched solvent from the frame chamber may be introduced into the frame chamber. The first solvent may be the same first solvent used when forming the first mixture in step 100 or may be another type of first solvent as described in greater detail above (e.g., a different light aromatic solvent from the light aromatic solvent mixed with the bitumen material).

The addition of second solvent and water to separate first solvent and second solvent, respectively, can proceed in a similar or identical fashion to the addition of first solvent into the frame chamber as described above. The addition of second solvent into the frame chamber loaded with first solvent-wet tailings can displace first solvent through the filter cloths and out of the frame chamber. Similarly, the addition of water into the frame chamber loaded with second solvent-wet tailings can displace second solvent through the filter cloths and out of the frame chamber.

When utilizing a filter press to carry out the method described herein, pressurized gas can be injected into the frame chamber before or after the addition of the first mixture, the first solvent, the second solvent, or the water. The addition of the pressurized gas can help promote the separation of the materials targeted for separation by, e.g., liberating the material from the mineral solids so that it may more freely be removed upon subsequent addition of a displacement liquid. The introduction of pressurized gas into the frame chamber can proceed according to the details provided above for applying pressurized gas over a first mixture.

In some embodiments, the above described method is carried out by utilizing countercurrent washing. After step 100 of adding first solvent to bitumen material to form a first mixture, the separation and addition steps 110, 120, and 130 can take place by moving the various materials through each other in opposite directions. For example, with respect to step 110, the separation step can be carried out by performing a countercurrent washing process where first solvent traveling in one direction is passed through the first mixture traveling in an opposite direction. In some embodiments, the first mixture is loaded at the bottom of a screw classifier conveyor positioned at an incline, while a second quantity of first solvent may be introduced at the top of the screw classifier conveyor. An exemplary screw classifier conveyor suitable for use in this method is described in U.S. Pat. No. 2,666,242. As the screw classifier conveyor moves the first mixture upwardly, the second quantity of first solvent flows down the inclined screw classifier conveyor and pass through the first mixture. The second quantity of first solvent can displace bitumen-enriched solvent contained in the first mixture, thereby "washing" the bitumen-enriched solvent from the first mixture.

Separation of the bitumen-enriched solvent and the first mixture may naturally occur based on the configuration of the screw classifier conveyor, with the predominantly liquid bitumen-enriched solvent collecting at one end of the washing unit and the predominantly solid first solvent-wet tailings at the opposite end of the washing unit. For example, when an inclined screw classifier conveyor is used, the bitumen-enriched solvent can collect at the bottom of the screw classifier conveyor, while the first solvent-wet tailings can collect at the top of the screw classifier conveyor. The bitumen-enriched solvent can include predominantly bitumen and first solvent.

The countercurrent process can include multiple stages. For example, after a first pass of first solvent through the first mixture, the resulting bitumen-enriched solvent can be passed through the resulting first solvent-wet tailings several more times. Alternatively, additional quantities of fresh first solvent can be passed through the resulting first solvent-wet tailings one or more times. In this manner, the bitumen-enriched solvent or fresh quantities of first solvent can become progressively more enriched with bitumen after each stage and the first solvent-wet tailings can lose progressively more bitumen after each stage.

Steps 120 and 130 can be carried out in a similar fashion. The first solvent-wet tailings obtained after washing the first mixture in a countercurrent process can be subjected to a countercurrent washing with second solvent. As the second solvent passes through the first solvent-wet tailings traveling in an opposite direction, the second solvent displaces the first solvent. Subsequently, the second solvent-wet tailings obtained after washing the first solvent-wet tailings in a countercurrent process can be subjected to a countercurrent washing with water. As the water passes through the second solvent-wet tailings traveling in an opposite direction, the water displaces the second solvent.

In some embodiments, the above described method is carried out by utilizing a vertical column. The first mixture prepared in step 100 can be loaded in a vertical column. Any method of loading the first mixture in the vertical column can be used. First mixture can be poured into the vertical column or, when an appropriate first mixture viscosity is obtained from mixing step 100, the first mixture can be pumped into the vertical column. First mixture can generally be loaded in the vertical column by introducing the first mixture into the column at the top end of the vertical column. The bottom end of the vertical column can be blocked, such as by a removable plug, valve, or by virtue of the bottom end of the vertical column resting against the floor. In some embodiments, a metal filter screen at the bottom end of the vertical column is used to maintain the first mixture in the vertical column. Accordingly, introducing first mixture at the top end of the vertical column can fill the vertical column with first mixture. The amount of first mixture loaded in the vertical column may be such that the first mixture substantially fills the vertical column with first mixture. In some embodiments, first mixture is added to the vertical column to occupy 90% or more of the volume of the vertical column. In some embodiments, the first mixture is not filled to the top of the vertical column so that room is provided to inject first solvent, second solvent, etc., into the vertical column.

In some embodiments, a pre-loading separation step is carried out after the mixture has been prepared in step 100 but before the mixture is loaded in the vertical column. The pre-loading separation step can include separating a liquid component of the first mixture from the first mixture. The liquid component can include a quantity of the bitumen-enriched first solvent that is produced upon mixing the first solvent and the bitumen material to form the first mixture. Because this liquid component is accessible immediately upon formation of the first mixture and relatively easy to separate from the first mixture using basic separation techniques, it can be separated from the first mixture prior to performing the further separation steps that occur in the vertical column and which are primarily aimed at separating the more inaccessible quantities of the bitumen-enriched solvent included in the first mixture.

The liquid component of the first mixture can be separated from the first mixture prior to loading the first mixture in the column by any suitable separation method capable of separating a liquid component from a first mixture. In some embodiments, any type of filtration process can be used wherein the liquid component passes through a filtration medium that does not allow solid particles of a certain size to pass therethrough. Accordingly, when filtration is performed, the liquid component including bitumen-enriched solvent passes through the filter while bitumen material having some bitumen-enriched solvent entrained therein will not pass through the medium. In other embodiments, the liquid component is separated by decanting the first mixture. When contained within a vessel, the first mixture can include a liquid component that resides above the bitumen material. Accordingly, the liquid component can be poured or skimmed off the top of the first mixture to separate the liquid component from the remainder of the first mixture.

In some embodiments where this pre-loading separation step is carried out, the amount of first solvent added to the bitumen material to form the first mixture is more than is added when a pre-loading separation step is not performed. The aim of adding this higher amount of solvent is to create a liquid component that is plentiful in the first mixture and relatively easy to access for purposes of separation from the first mixture. In some embodiments, an amount 1.5 to 3 times the typical amount of first solvent is used to ensure that the pre-loading separation step may be carried out.

As mentioned previously, the first solvent used in step 100 to form the first mixture can be disbit. In some embodiments, the first solvent used to form the first mixture is preferably disbit when a pre-loading separation step is to be carried out.

As noted above, the column can have a generally vertical orientation. The vertical orientation can include aligning the column substantially perpendicular to the ground, but also can include orientations where the column forms angles less than 90° with the ground. The column can generally be oriented at any angle that results in gravity aiding the flow of the first solvent, second solvent, etc., from one end of the column to the other. In some embodiments, the column is oriented at an angle anywhere within the range of from about 1° to 90° with the ground. In a preferred embodiment, the column is oriented at an angle anywhere within the range of from about 15° to 90° with the ground.

The material of the vertical column is also not limited. Any material that will hold the first mixture within the vertical column can be used. The material can also preferably be a non-porous material such that various liquids injected into the vertical column only exit the column from one of the ends of the vertical column. The material can be a corrosive resistant material so as to withstand the potentially corrosive components of the first mixture loaded in the column as well as any potentially corrosive materials injected into the vertical column.

The shape of the vertical column is not limited to a specific configuration. Generally speaking, the vertical column can have two ends opposite one another, designated a top end and a bottom end. The cross-section of the vertical column can be any shape, such as a circle, oval, square or the like. The cross-section of the vertical column can change along the height of the column, including both the shape and size of the vertical column cross-section. The vertical column can be a straight line vertical column having no bends or curves along the height of the vertical column. Alternatively, the vertical column can include one or more bends or curves.

Any dimensions can be used for the vertical column, including the height, inner cross sectional diameter and outer cross sectional diameter of the vertical column. In some embodiments, the ratio of height to inner cross sectional diameter ranges from 0.5:1 to 15:1.

Once first mixture is loaded in the vertical column, the separation and addition steps 110, 120, and 130 are carried out. With respect to step 110, separation of the bitumen-enriched solvent from the first mixture loaded in the column can be accomplished by adding a second quantity of first solvent into the vertical column. The second quantity of first solvent can be added into the vertical column at either the top end of the column (down flow mode) or the bottom end of the column (up flow mode). When a down flow mode is used, the second quantity of first solvent flows downwardly through the first mixture loaded in the column. As the second quantity of first solvent flows downwardly through the column, it can displace bitumen-enriched solvent from the column. When an up flow mode is used, the second quantity of first solvent flows upwardly through the first mixture loaded in the column. As the second quantity of first solvent flow upwardly through the column, it can dissolve further bitumen contained in the first mixture and displace bitumen-enriched solvent in the first mixture. A gas overpressure as described in greater detail above, can then be used to displace the dissolved bitumen and first solvent back down through the first mixture and out of the column.

The second quantity of first solvent can be added into the vertical column by any suitable method. In some embodiments, the second quantity of first solvent is poured or pumped into the vertical column at the top end and allowed to flow down through the first mixture loaded therein under the influence of gravity. In some embodiments, the second quantity of the first solvent is pumped into the column from the bottom end of the column. External pressures can also be added to promote the downward flow of the first solvent after it has been added into the vertical column.

In some embodiments, the second quantity of first solvent is added to the vertical column under flooded conditions. In other words, more first solvent is added to the top of the vertical column than what flows down through the first mixture, thereby creating a head of solvent at the top of the vertical column.

Upon addition into the column in a down flow mode, the first solvent can flow downwardly through the height of the column via small void spaces in the first mixture. The first solvent can flow downwardly through the force of gravity or by an external force applied to the vertical column. Examples of external forces applied include the application of pressure from the top of the vertical column or the application of suction at the bottom of the vertical column. The first solvent can travel the flow of least resistance through the first mixture. As the first solvent flows downwardly through the first mixture, bitumen enriched solvent contained in the first mixture can be displaced downwardly through the column.

Upon addition into the column in an up flow mode, the first solvent flows upwardly through the height of, the column via small void spaces in the first mixture. The first solvent can flow upwardly through the continuous pumping of first solvent into the column from the bottom end of the column. As the first solvent flows upwardly through the first mixture, bitumen in the first mixture may be dissolved and bitumen-enriched solvent contained in the first mixture may be displaced upwardly. After the first solvent has been added to the column in an up flow mode, the dissolved bitumen and solvent can flow downwardly back through the column as described above in the down flow mode. The force acting on the dissolved bitumen and solvent can either be gravity or an external force, such as a gas overpressure.

The bitumen-enriched solvent that has flowed downwardly through the height of the vertical column in either mode can exit the bottom end of the vertical column, where it can be collected. Any method of collecting the bitumen-enriched solvent can be used, such as by providing a collection vessel at the bottom end of the vertical column. The bottom end of the vertical column can include a metal filter screen having a mesh size that does not permit first mixture to pass through but which does allow for bitumen-enriched solvent to pass through and collect in a collection vessel located under the screen. Collection of bitumen-enriched solvent can be carried out for any suitable period of time. In some embodiments, collection is carried out for 2 to 30 minutes.

Bitumen-enriched solvent that has exited the column can be recycled back into the top or bottom of the vertical column to perform further displacement of any bitumen-enriched solvent still contained in the vertical column. The collection and reintroduction of the bitumen-enriched solvent into the column can be performed several times in an attempt to increase the amount of bitumen removed from the column. Alternatively, or in conjunction with adding bitumen-enriched solvent into the column, further amounts of fresh first solvent can be added to the column to displace bitumen-enriched solvent.

With respect to step 120, a quantity of second solvent is added into the column in a similar manner as described above with respect to the addition of the first solvent in order to displace first solvent entrapped in the column, including the addition of the second solvent under flooded conditions. The second solvent can be similar or identical to the second solvent described in greater detail above.

The quantity of second solvent can be added into the column at the top end of the column such that the quantity of second solvent flows downwardly through the first solvent-wet tailings loaded in the column. As the second solvent flows downwardly, the second solvent displaces first solvent and eventually forces the first solvent to exit the column at the bottom end of the column. A mixture of first solvent and second solvent exiting the column can then be collected.

As with the bitumen-enriched solvent collected in the previous step after the addition of first solvent, the mixture of first solvent and second solvent collected can be reintroduced into the vertical column to promote further displacement of first solvent from the column. The collecting and reintroductions step can be performed one or more times. Alternatively or conjunction with the recycling of the first solvent and second solvent mixture, additional fresh second solvent can be added to the column to displace first solvent contained therein.

In some embodiments, addition of the quantity of second solvent into the column includes a two-stage addition of the quantity of second solvent wherein one stage is performed after the first solvent-wet tailings have been temporarily discharged from the column. The two stage addition of the quantity of second solvent may be useful when the first solvent-wet tailings includes a water content (likely originating from the original bitumen material). This water content can interfere with the ability of the second solvent to act as a displacement solvent capable of displacing first solvent out of the column. However, the two stage addition of the second solvent described herein can overcome this issue.

In a first stage addition, the first solvent-wet tailings is first discharged from the column. Any manner of discharging the first solvent-wet tailings from the column can be used. In some embodiments, the screen, plug, or valve blocking the bottom end of the vertically oriented column is removed to allow the first solvent-wet tailings to pass out of the bottom end of the column.

After discharging the first solvent-wet tailings from the column, a first portion of the quantity of second solvent is added to the first solvent wet tailings. Any manner of adding the first portion of the quantity of second solvent to the first solvent-wet tailings can be used, such as by pouring the first portion of the quantity of second solvent over the first solvent-wet tailings. In some embodiments, the first solvent-wet tailings is discharged from the column into a vessel that is capable of containing both the first solvent-wet tailings and the first portion of the quantity of the second solvent.

The first portion of the quantity of the second solvent can be any percentage of the quantity of the second solvent. In some embodiments, the first portion of the quantity of the second solvent is from 25% to 50% of the total quantity of the second solvent.

The addition of the first portion of the quantity of the second solvent to the first solvent-wet tailings results in the first solvent-wet tailings temporarily becoming first/second solvent-wet tailings and the formation of a liquid component. The liquid component can generally includes first solvent, second solvent, water, and dissolved bitumen. However, the liquid component preferably does not include solid particles of the tailings, such as silica and clay.

Liquid component can be separated from the first/second solvent-wet tailings. Any manner of separating liquid component from the first/second solvent-wet tailings can be used, such as by decanting liquid component from the vessel used to hold the first/second solvent-wet tailings and the first portion of the quantity of the second solvent. Any amount of the liquid component can be separated, and preferably most or all of the liquid component is separated.

Once a portion or all of the liquid component is separated from the first/second solvent wet tailings, the first/second solvent-wet tailings are loaded back into the column. The manner of loading the first/second solvent-wet tailings back into the column can be similar or identical to the manner in which the first mixture is loaded into the column as described in greater detail above.

After the first/second solvent-wet tailings are loaded back into the column, the second portion of the quantity of the second solvent is added into the column to displace first solvent from the column. This addition of the second portion of the quantity of second solvent can be as described in greater detail above. In some embodiments, the second portion of the quantity of second solvent is from about 50% to about 75% of the quantity of second solvent used in step 120. As described in greater detail above, the addition of the second solvent drives out most or all of the first solvent and therefore results in the first solvent-wet tailings (or the first/second solvent wet tailings) becoming second solvent-wet tailings.

With respect to step 130, water is added into the column in the same manner as described above with respect to the addition of the first solvent and the second solvent into the column. The addition of water serves to displace the second solvent from the vertical column. Mixtures of water and second solvent can be collected and reintroduced into the column to displace further second solvent from the column. Alternatively or in conjunction with adding the water and second solvent mixture back into the column, additional water can be added to the column to displace further second solvent from the column.

As with step 120, step 130 can be carried out in two steps, with one step occurring after the second solvent-wet tailings have been discharged from the column. Each of the steps in adding the quantity of water to the second solvent-wet tailings may proceed as outlined above with respect to the two stage addition of second solvent to the first solvent-wet tailings, including the discharging of the second solvent-wet tailings from the column, the addition of the first portion of the quantity of water to the second solvent-wet tailings, the separation of the liquid component from the second solvent/water-wet tailings, the re-loading of the second solvent/water-wet tailings into the column, and the addition of the second portion of the first quantity of water to the second solvent/water-wet tailings loaded in the column. Furthermore, the first portion and second portion of the quantity of water can be divided in a similar or identical manner to the first portion and second portion of the quantity of second solvent (i.e., 25% to 50% for the first portion and 50% to 75% for the second portion).

The material contained in the vertical column after the removal of second solvent generally includes solvent-dry stackable tails as described in greater detail above. The solvent-dry, stackable tails can be removed from the vertical column by any suitable process. The solvent-dry, stackable tailings can be removed from either the top end or the bottom end of the vertical column. In some embodiments, the bottom end of the vertical column is covered with one or more removable plug or valve, and the one or more plug or valve can be removed to allow the solvent-dry, stackable tailings to discharge out of the vertical column by the force of gravity. For example, if the bottom end of the vertical column is blocked by a screen as described in greater detail above, the screen can be removed to allow the solvent-dry, stackable tailings to flow out of the vertical column. Alternatively, the screen may be an annular ring at the lower part of the column to allow dissolved bitumen or liquids to pass without obstructing the outflow of solids once the plug or valve is removed. In certain embodiments, the vertical column is lifted off of the ground, thereby allowing the solvent-dry, stackable tailings to flow out of the bottom end of the vertical column. External forces can also be applied to the vertical column to promote the discharging of the solvent-dry, stackable tailings from the vertical column.

In some embodiments, any of the solvents or water added into the column can be added into the column from the bottom of the column to create an upflow of solvent or water into the column. Solvents or water can be added in this manner to unplug a vertical column that has become plugged. The bottom of the column may be closed off to force the solvent or water upwards when introduced at the bottom of the column. For example, increasing the flow rate and pressure of the injected solvent or water can result in closing off the bottom of the column. The upwardly moving solvent or water can then displace or dissolve the material causing the plug in the column.

Figure 2:
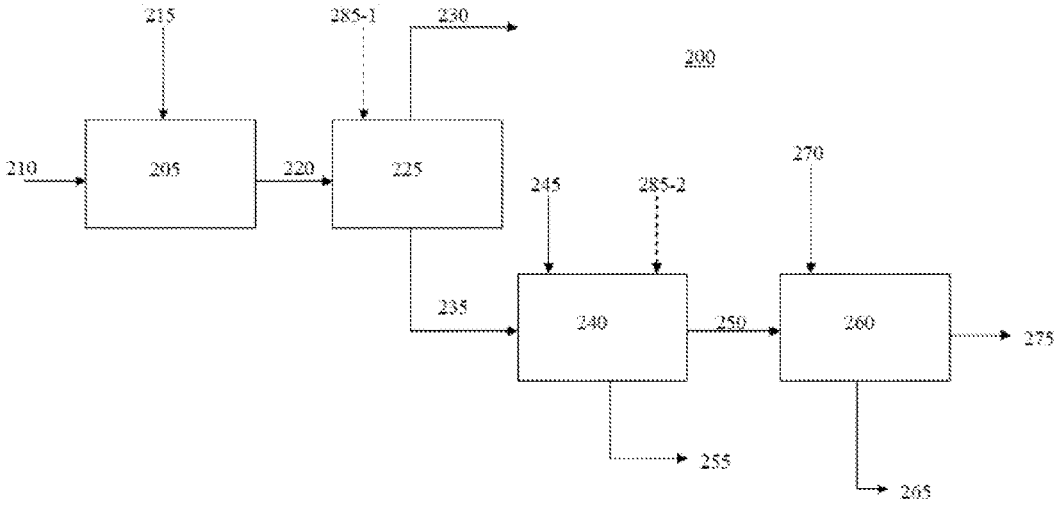
FIG. 2 is a schematic diagram for a system and method for producing solvent-dry, stackable tailings as disclosed herein.

With reference to FIG. 2, a system 200 for carrying out the above-described method includes a mixer 205 for mixing bitumen material 210 and first solvent 215. Any suitable mixing vessel can be used, including a mixing vessel that operates under pressure in order to maintain the first solvent 215 as a liquid. A first mixture 220 is formed by the mixing of the bitumen material 210 and the first solvent 215 in the mixer 205. The first mixture 220 is transported to a first separation unit 225 where bitumen-enriched solvent 230 is separated from the first mixture 220. Any separation unit suitable for separating the bitumen-enriched solvent 230 from the first mixture 220 can be used. Gas 285-1 can be pumped into the first separation unit 225 to promote separation of bitumen from the non-bitumen components of the bitumen material. When gas 285-1 is pumped into first separation unit 225, the spent gas may also exit the first separation unit 225 with the bitumen-enriched solvent 230. Because the gas does not dissolve in either the bitumen or the first solvent of the first mixture 220, the gas exits with the bitumen-enriched solvent 230 and does not require any additional separation processing (but may be recovered and reused from an economics standpoint). Removal of the bitumen-enriched solvent 230 from the first mixture 220 via first separation unit 225 results in the first mixture 220 becoming first solvent-wet tailings 235. The first solvent-wet tailings 235 produced by the first separation unit 225 are transported to a second separation unit 240 where second solvent 245 is added to the first solvent-wet tailings 235 in order to separate first solvent 255 from the first solvent-wet tailings 235. Any separation unit suitable for separating the first solvent 255 from the first solvent wet tailings 235 may be used. Gas 285-2 may be pumped into the second separation unit 240 to promote separation of the first solvent 255 from the non-bitumen components of the first solvent-wet tailings 235. When gas 285-2 is pumped into second separation unit 240, the spent gas may also exit the second separation unit 240 with the first solvent 255. Because the gas does not dissolve in the first solvent 255, the gas exits without need for any additional separation processing, but may be recovered and reused from an economics standpoint. Separation of the first solvent 255 from the first solvent-wet tailings 235 results in the first solvent-wet tailings 235 becoming second solvent-wet tailings 250. The second solvent-wet tailings 250 are transported to a third separation unit 260 where the second solvent 265 is removed from the second solvent-wet tailings 250 by adding water 270 to the second solvent-wet tailings 250. Any separation unit suitable for separating the second solvent 265 from the second solvent wet tailings 250 may be used. Separation of the second solvent 265 from the second solvent-wet tailings 250 results in the second solvent-wet tailings 250 becoming solvent-dry, stackable tailings 275.

Figure 3:
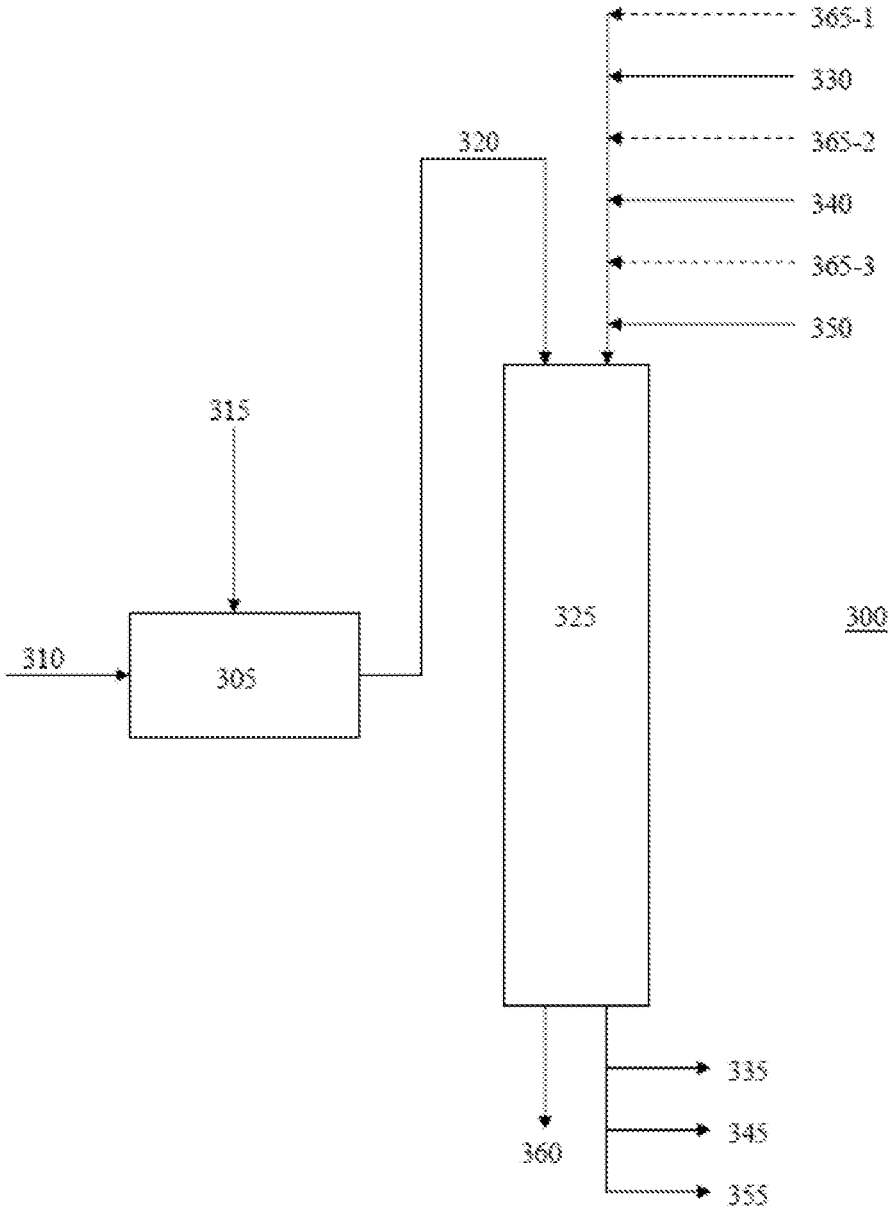
FIG. 3 is a schematic diagram for a system and method for producing solvent-dry, stackable tailings as disclosed herein.

With reference to FIG. 3, a system 300 for carrying out the extraction method disclosed herein that utilizes a vertical column includes a mixing vessel 305 for mixing bitumen material 310 with a first quantity of first solvent 315 to form a first mixture 320. Any type of mixing vessel may be used to mix the bitumen material 310 and the first solvent 315.

The first mixture 320 is then loaded in the vertical column 325. FIG. 3 depicts the first mixture 320 being loaded in the top end of the vertical column 325, but the first mixture 320 can also be loaded from the bottom end of the vertical column 325 or from the side of the vertical column 325. Once the first mixture 320 is loaded in the vertical column 325, a second quantity of first solvent 330 is injected into the top end of the vertical column. The second quantity of first solvent 330 flows down the height of the vertical column 325, dissolving solid bitumen in the first mixture 320 and/or displacing dissolved bitumen in the first mixture 320 along the way. The non-bitumen components of the bitumen material remain in a packed condition in the vertical column 325 as the second quantity of first solvent 330 passes through the first mixture 320. The second quantity of first solvent 330 exits the bottom end of the vertical column 325 as a bitumen-enriched solvent phase 335. The second quantity of first solvent 330 is now a bitumen-enriched solvent phase 335 because the second quantity of first solvent 330 dissolves solid bitumen contained in the first mixture 320 and/or coalesces with dissolved bitumen contained in the first mixture 320 as the second quantity of first solvent 330 passed through the vertical column 325.

The bitumen-enriched solvent phase 335 is collected at the bottom end of the vertical column 325 for further processing of the bitumen contained therein. Some of the second quantity of first solvent 330 remains in the first mixture 320 loaded in the vertical column 325. A quantity of second solvent 340 is then added to the vertical column 325. The quantity of second solvent 340 flows down the height of the vertical column 325, dissolving and/or displacing first solvent contained in the first mixture 320. The quantity of second solvent 340 exits the bottom end of the vertical column 325 as a first solvent-second solvent mixture 345.

The first solvent-solvent mixture 345 is collected at the bottom end of the vertical column 325 to recover and possibly reuse the first and second solvents contained therein.

A portion of the second solvent added into the vertical column 325 remains behind in the mixture loaded in the vertical column 325. Water 350 is added to the vertical column 325 to displace second solvent out of the vertical column 325. The water 350 flows down the height of the vertical column 325, displacing second solvent contained in the first mixture 320. The water 350 exits the bottom end of the vertical column 325 as a water and second solvent mixture 355, which can be separated into water and second solvent so each component may be reused.

Optionally, the system also includes one or more gas purge injections 365-1, 365-2, and 365-3. The gas purge injections 365-1, 365-2, and 365-3 may occur before and/or after any of the solvent or water injection steps, and may serve to help separate bitumen, first solvent, and second solvent from the non-bitumen component of the first mixture 320.

After displacement of second solvent, the material loaded in the column 325 is solvent-dry, stackable tailings 360. The solvent-dry, stackable tailings 360 is discharged out of the vertical column 325. FIG. 3 depicts solvent-dry, stackable tailings 360 being removed from the bottom end of the vertical column 325, but the solvent-dry, stackable tailings 360 may also be discharged from the top end of the vertical column 325.

Figure 4:
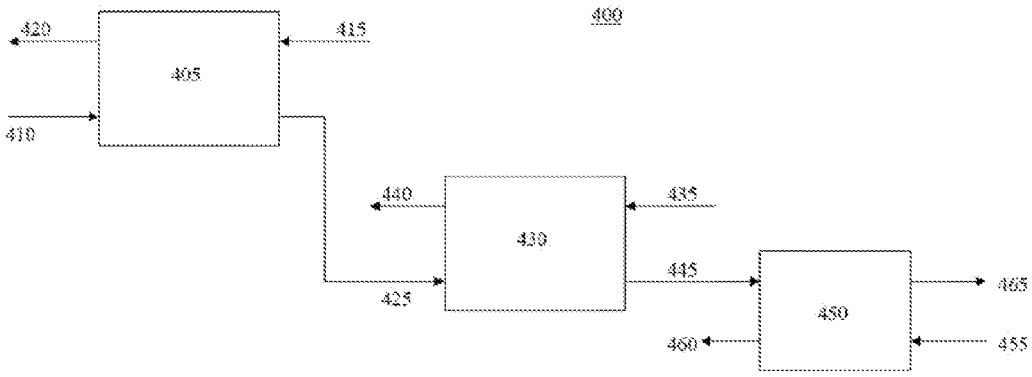
FIG. 4 is a schematic diagram for a system and method for producing solvent-dry, stackable tailings as disclosed herein.
Figure 5:
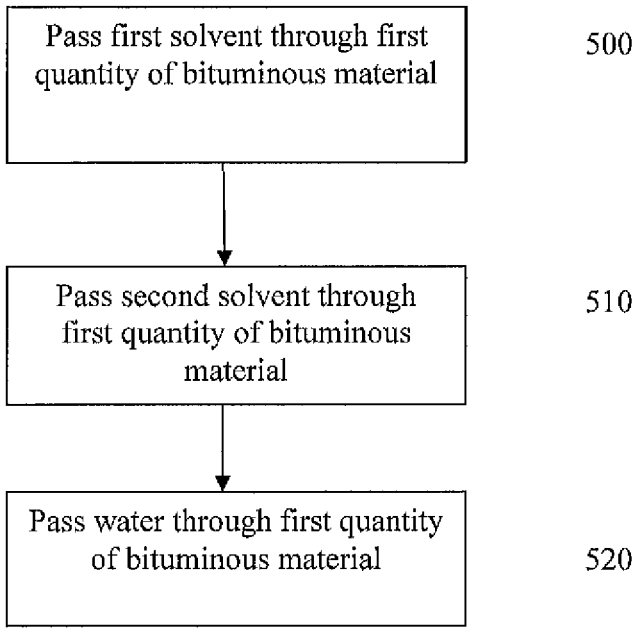
FIG. 5 is a flow chart detailing a method for producing solvent-dry, stackable tailings as disclosed herein.
Figure 6:
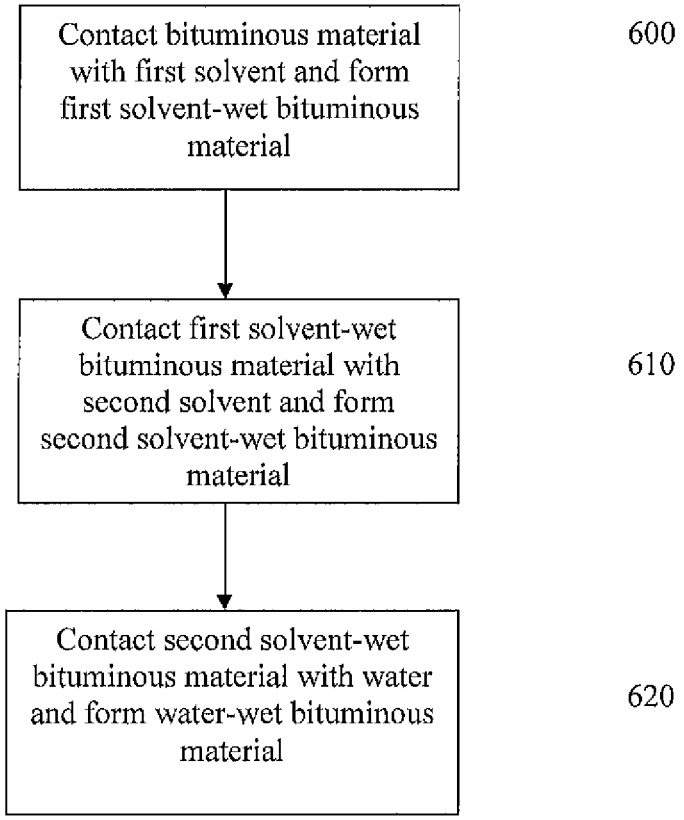
FIG. 6 is a flow chart detailing a method for producing solvent-dry, stackable tailings as disclosed herein.

With reference to FIG. 4, a system for carrying out the extraction method disclosed herein that utilizes countercurrent washing includes loading a first mixture 410 of bitumen material and first solvent in a washing unit 405. The washing unit 405 receives the first mixture 410 and transports it in a first direction while moving first solvent 415 towards the first mixture 410 in a direction opposite the direction the first mixture 410 is traveling. The first mixture 410 mixes with the first solvent 415, during which bitumen-enriched solvent in the first mixture 410 is displaced from the first mixture 410 by the first solvent 415. Bitumen-enriched solvent 420 and first solvent-wet tailings 425 separate due to the countercurrent configuration of the washing unit 405.

First solvent-wet tailings 425 are transported to a second washing unit 430 where it flows in a direction opposite to a direction of flow of second solvent 435 introduced into the second washing unit 430. The first solvent-wet tailings 425 mix with the second solvent 435, during which the first solvent in the first solvent-wet tailings 425 is displaced by the second solvent 435. Accordingly, first solvent-second solvent mixture 440 and second solvent-wet tailings 445 are formed. The first solvent-second solvent mixture 440 and the second solvent-wet tailings 445 separate due to the countercurrent configuration of the second washing unit 430.

Second solvent-wet tailings 445 are transported to third washing unit 450 where it flows in a direction opposite to a direction of flow of water 455 introduced into the second washing unit 450. The second solvent-wet tailings 445 mix with the water 455, during which the second solvent in the second solvent-wet tailings 445 is displaced by the water 455. Accordingly, second solvent-water mixture 460 and solvent-dry, stackable tailings 465 are formed. The second solvent-water mixture 460 and the solvent-dry, stackable tailings 465 separate due to the countercurrent configuration of the third washing unit 450. The final stage 450 may be a column, vessel, or plate and frame filter as described previously to effect a more efficient final water removal to produce solvent-dry stackable tailings.

In any of the embodiments described herein, the method can include a further step of depositing the solvent-dry, stackable tailings in a mine pit formed when mining the first bitumen material. The manner in which the solvent-dry, stackable tailings are deposited in the mine pit is not limited. In one example, the solvent-dry, stackable tailings is transported to the mine pit by one or more trucks and poured into the mine pit from the trucks. Solvent-dry, stackable tailings may also be deposited in a mine pit through the use of conveyor belts that empty into the mine pits. In some embodiments, the volume of solvent-dry, stackable tailings produced from the mined bitumen material is less than the original amount of bitumen material mined such that the entirety of the solvent-dry, stackable tailings may be deposited in the mine pit. To the contrary, conventional hot water processing of bitumen material generally produce wet tailings having a volume that is 125% of the original volume of the mined bitumen material, even after settling and decanting of excess liquid. Additionally, the presence of some amount of water in the solvent-dry, stackable tailings may aid in the compaction of the solvent-dry, stackable tailings. This can lead to a much earlier trafficable reclamation for the deposit, an aspect of tailings management which has not been attained by tar sands operators to date.

As described in greater detail in co-pending U.S. application Ser. Nos. 12/041,554 and 11/249,234, further processing can be performed on other components produced by the methods described above. For example, the bitumen-enriched solvent phase can be processed to separate the bitumen therefrom. Furthermore, as described in co-pending application Ser. No. 12/509,298, herein incorporated by reference, any bitumen obtained from the above-described methods or from further processing of the bitumen-enriched solvent phases produced by the above-described processes can be cracked in a nozzle reactor (with or without deasphalting) to produce light hydrocarbon distillate. The light hydrocarbon distillate can then be used as a first solvent to extract bitumen from bitumen material. In one example, the light hydrocarbon distillate produced is recycled within the same process to initiate extraction of bitumen from further bitumen material. Additionally, any solvent separated or removed from a mixture can be recovered and reused in the process. For example, the first solvent-enriched second solvent phase can be recovered after being separated from the second solvent-wet tailings and reused in the process. More specifically, the first solvent-enriched second solvent phase is separated into first and second solvent that may be used in the process. Separation of the solvents may be accomplished by any know method, such as through the use of stills.

In some embodiments, tailings produced by a bitumen extraction process are treated with water to remove paraffinic solvent contained in the tailings. The paraffinic solvent can be present in the tailings as a result of using paraffinic solvent to wash a solvent from the tailings that was previously used to dissolve and remove bitumen from bituminous material. The water effectively removes paraffinic solvent from the tailings at least in part because of the immiscibility of the water and paraffinic solvent. For example, when tailings are treated with water by passing a plug of water through the tailings, the immiscibility of the water and paraffinic solvent helps to ensure that the water pushes the paraffinic solvent out of the tailings rather than mix with the paraffinic solvent and potentially leave a mixture of paraffinic solvent and water in the tailings.

In some embodiments, a method of performing bitumen extraction on bituminous material that includes the formation of solvent-dry tailings includes a step 500 of passing a first solvent through a first quantity of bituminous material, a step 510 of passing a second solvent through the first quantity of bituminous material, and a step of 520 of passing water through, the first quantity of bituminous material. In this method, the second solvent is a paraffinic solvent.

In step 500, first solvent is passed through a first quantity of bituminous material. One aim of step 500 is to dissolve bitumen contained in the bituminous material into the first solvent as a means for eventually extracting the bitumen content from the bituminous material. The first solvent typically passes through the bituminous material by traveling through the interstitial spaces within the bituminous material. As it passes through these spaces, the first solvent contacts bitumen contained in the bituminous material and dissolves the bitumen. The solvent thus becomes "bitumen-enriched," and when the bitumen-enriched solvent has passed all the way through the bituminous material, bitumen content in the bituminous material has been effectively extracted from the bituminous material.

The bituminous material can be similar or identical to the bitumen material described in greater detail above. In some embodiments, the bituminous material is oil sand or tar sand. In some embodiments, the bituminous material is obtained from previous bitumen extraction process steps. For example, in some embodiments, oil sand or the like is mixed with solvent capable of dissolving bitumen (e.g., aromatic solvents such as those discussed in greater detail above), and the resulting mixture is separated into a bitumen-enriched solvent phase and a bitumen-depleted tailings phase. The mixing can be carried out in a mixing drum or the like, and the separation can be carried out using a thickener, hydrocyclone, or the like. The bitumen-enriched solvent phase can be subjected to further processing that separates the solvent from the bitumen. Separated solvent can be reused in the process and bitumen can be subjected to upgrading processes. The bitumen-depleted tailings phase from such a process will typically include a solvent content and a bitumen content in addition to the sand and clay of the original oil sand. For example, in some embodiments, the bitumen-depleted tailings phase includes up to 40% of the bitumen contained in the original oil sand. This bitumen-depleted tailings can serve as the bituminous material used in the method described herein.

Any technique that results in the passing of first solvent through the bituminous material can be used. In some embodiments, the first solvent is passed through the bituminous material by loading the bituminous material in a vessel, adding solvent at one end of the vessel, and causing the solvent to move through the bituminous material to the opposite end of the vessel. Any vessel capable of containing the bituminous material can be used, and the size and shape of the vessel is not limited. Solvent can be moved through the bituminous material using, for example, gravity or an external force, such as the application of an inert gas at one end of the vessel. When inert gas is used to move solvent through the bituminous material, the vessel can be a sealed vessel, so that the introduction of inert gas into one end of the vessel forces the solvent to move through the bituminous material to the other end of the vessel.

In some embodiments, the vessel or sealed vessel is a vertical column as described in greater detail above. The bituminous material is loaded in the vertical column as described above, and solvent is added to the top end of the vessel such that it may move downwardly through the bituminous material loaded in the vertical column to the bottom end of the vessel. As mentioned above, gravity can be relied on to move the solvent down through the bituminous material, or the vertical column can be a sealed vertical column and inert gas can be introduced at the top end of the vertical column after solvent has been added into the column to force the solvent to move downwardly through the bituminous material loaded in the vertical column. When inert gas is used to promote the movement of the solvent through the bituminous material, the inert gas can be applied at a pressure ranging from 30 psig to 300 psig. Typically, the pressure at which the inert gas is applied into vertical column can vary based on how packed the bituminous material is in the vertical column, the height of the column, and the resulting pressure drop over the column length. The more packed the bituminous material, the greater the pressure will need to be to move the solvent downwardly through the bituminous material. Any suitable inert gas can be used, and in some embodiments, the inert gas is nitrogen.

The first solvent used in step 500 can be similar or identical to the first solvent described in greater detail above. The first solvent is preferably a solvent capable of dissolving bitumen, and can be an aromatic solvent, such benzene, toluene, xylene, aromatic alcohols, kerosene, diesel (including biodiesel), light gas oil, light distillate (distillate having boiling point temperature in the range of from 140° C. to 260° C.), commercial aromatic solvents such as Aromatic 100, Aromatic 150, and Aromatic 200, and/or naphtha.

The amount of solvent passed through the bituminous material in step 500 typically depends on the bitumen content of the bituminous material, although other factors can impact how much solvent is passed through the bituminous material. In some embodiments, a ratio of solvent to bitumen content of the bituminous material on a volume basis (or S:B ratio) is used to specify the amount of solvent passes through the bituminous material. The S:B ratio in step 500 can vary from between 0.5:1 to 3:1.

The first solvent that passes through the bituminous material will have a bitumen content based on the amount of bitumen that dissolves into the first solvent as it passes through the bituminous material. In some embodiments, the first solvent will have removed from 40% to 75% of the bitumen content of the bituminous material. The first solvent that passes through the bituminous material can therefore be collected and subjected to further processing that separates the solvent from the bitumen content. The separated solvent can be reused in the process, and the bitumen can be subjected to upgrading processes to produce lighter hydrocarbons.

In some embodiments, a portion of the first solvent that is introduced into the bituminous material will not pass all the way through the bituminous material, and will instead remain in the interstitial pores of the bituminous material. This trapped first solvent can still have dissolved bitumen therein, and therefore step 510 of passing second solvent through the bituminous material can be carried out in order to displace the trapped first solvent out of the bituminous material.

Step 510 can be similar or identical to step 500 described above, with the exception of using a second solvent in place of a first solvent. In embodiments where the bituminous material is loaded in a vessel, such as a sealed vertical column, the second solvent can be added at the top end of the vertical column and allowed to move down through the bituminous material either via the force of gravity or by applying an external force, such as the addition of inert gas into the vertical column following the addition of second solvent. The second solvent passes through the bituminous material, and in so doing, displaces the first, solvent trapped in the bituminous material and moves the trapped first solvent through the bituminous material. Eventually, a mixture of second solvent and previously trapped first solvent will pass out of the bituminous material.

Any second solvent capable of displacing the first solvent can be used in step 510. It is also preferable that the second solvent used be capable of dissolving bitumen and that the second solvent is miscible with the first solvent so that the second solvent moving through the bituminous material both forces the trapped first solvent out of the bituminous material and dissolves any bitumen contained in the bituminous material that was not dissolved by the first solvent. In some embodiments, the second solvent is a paraffinic solvent, such as ethane, butane, pentane, hexane and heptane. Paraffinic solvents are useful as second solvents because they are capable of both displacing and diluting first solvent and dissolving bitumen, and, as discussed in greater detail below, are immiscible with water and can therefore be readily removed from the bituminous material via a water wash.

As with the first solvent, the amount of second solvent passed through the bituminous material can depend on factors such as the bitumen content of the bituminous material. In some embodiments, the ratio of volume of second solvent added to the bituminous material to the original bitumen volume in the bituminous material is from 0.5:1 to 3:1.

A portion of the second solvent introduced into the bituminous material will pass through the entirety of the bituminous material, and can be collected as it leaves the bituminous material. The second solvent that leaves the bituminous material will include first solvent that was previously trapped in the bituminous material and some dissolved bitumen. In some embodiments, 99% of the first solvent trapped in the bituminous materials will be removed by the second solvent (in one or multiple washes of second solvent), meaning that after the second solvent is passed through the bituminous material, the bituminous material may contain less than 200 ppm of first solvent. Additionally, the second solvent passing through the bituminous material may dissolve a majority of the bitumen that remained undissolved in the bituminous material after passing the first solvent through the bituminous material. In some embodiments, the bituminous material contains less than 1 wt % of the bitumen content present in the original bituminous material. The mixture of second solvent, first solvent, and dissolved bitumen that exits the bituminous material can be collected and treated to separate the three components. The recovered first and second solvents can be reused in the process, and the bitumen can be subjected to upgrading.

A portion of the second solvent introduced into the bituminous material will become trapped in the interstitial pores of the bituminous material. For example, 40% of the second solvent introduced into the bituminous material can become trapped in the bituminous material. In some embodiments, this second solvent can have some bitumen dissolved therein, and it can therefore be useful to take steps to try and remove this second solvent from the bituminous material.

In step 520, water is passed through the bituminous material having second solvent trapped therein in an effort to move the second solvent out of the bituminous material. As noted above, the water is effective at displacing the paraffinic second solvent from the bituminous material due to the immiscibility of the paraffinic second solvent and the water. For example, when a plug of water is moved through the bituminous material, the paraffinic solvent is pushed out of the paraffinic solvent by the water plug rather than mixing with the water, which could possibly lead to paraffinic solvent remaining in the bituminous material.

Passing water through the bituminous material can be carried out in a similar or identical fashion to how the first solvent and second solvent are passed through the bituminous material. While any manner of passing the water through the bituminous material can be used, some embodiments call for the water to be passed through bituminous material loaded in a vessel, such as a sealed vertical column. In such embodiments, water is introduced at the top end of the sealed vertical column, and moves downwardly through the bituminous material under the force of gravity or through the application of external force. In some embodiments, inert gas is introduced into the top end of the sealed vertical column after water has been introduced into the top end of the sealed vertical column to push the water downward through the bituminous material. When inert gas is introduced, the inert gas can be introduced at a pressure of from 30 to 50 psig. In some embodiments, the pressure of the inert gas is kept relatively low so as not to move the water through the bituminous material at a velocity that results in disrupting the clays attached to the sand particles in the bituminous material.

The amount of water used in step 520 can be based on a ratio of volume of water added to the total volume of the interstitial pore spaces in the bituminous material (W:P ratio). In some embodiments, the W:P ratio for step 520 is from 1:1 to 5:1, meaning that, generally speaking, a volume of water anywhere from one to five times the volume of pore spaces in the bituminous material is passed through the bituminous material.

The water passing through the bituminous material in step 520 will result in second solvent and water exiting the bituminous material. The second solvent can include dissolved bitumen, and therefore steps can be taken to separate the water, second solvent, and bitumen. Generally speaking, the water and second solvent (having bitumen dissolved therein) is relatively easy to separate due to the immiscibility of the second solvent in the water. In some embodiments, the second solvent and water may naturally phase separate, forming a layer of solvent over the water. Once the solvent and water are separated, the second solvent can be processed to separate the solvent from the bitumen. Separated water and solvent can be reused in the process, and bitumen can be subjected to upgrading processing.

Any of the above described steps wherein first solvent, second solvent, or water is passed through the bituminous material can be performed in multiple stages. That is to say, multiple quantities of first solvent can be passed through the bituminous material in individual stages prior to passing any second solvent through the bituminous material. Similarly, multiple quantities of second solvent can be passed through the bituminous material in individual stages prior to passing water through the bituminous material. And finally, multiple quantities of water can be passed through the bituminous material in individual stages after the second solvent wash has been completed. Using multiple stages of washes for one or more of the first solvent, second solvent, and water can result in more complete removal of bitumen, first solvent, and second solvent from the bituminous material.

After steps 500, 510, and 520 have been carried out, a tailings phase is left over. When a vessel is used to carry out these steps, the tailings Scan be discharged from the vessel. The tailings phase generally includes the non-bitumen solid materials of the original bituminous material, such as sand and clay. In conventional bitumen extraction processes that utilize solvents, the tailings include a solvent content. However, in the above method, the second solvent and water washes can result in the production of tailings that have less than 200 ppm first solvent and less than 100 ppm second solvent. Additionally, the tailings can include less than 2 wt % of the original bitumen content of the bituminous material. Bitumen and solvent levels in these ranges can satisfy stringent environmental regulations set by various organizations overseeing oil sand mining and bitumen extraction.

The tailings can also include a water content due to the water content present in the original bituminous material and the water added to the bituminous material as part of removing second solvent from the bituminous material. In some embodiments, the water content of the tailings is about 14 wt % and the tailings can be transported by conveyor for deposition. In some embodiments, it may be useful to add additional water to the discharged tailings so that the tailings are in the form of a pumpable slurry.

In some embodiments, a method of extracting bitumen from bituminous material and producing solvent-dry tailings includes a step 600 of contacting a bituminous material with a first solvent and forming a first solvent-wet bituminous material, a step 610 of contacting the first solvent-wet bituminous material with a second solvent and forming a second solvent-wet bituminous material, and a step 620 of contacting the second solvent-wet bituminous material with water and forming a water-wet bituminous material. In the method described above, the second solvent is preferably a paraffinic solvent.

The first solvent, second solvent, water, and bituminous material used in steps 600, 610, and 620 are similar or identical to the first solvent, second solvent, and water described above in the method including steps 500, 510, and 520.

Any or all of the contacting steps 600, 610, and 620 can include passing the first solvent, second solvent, and water through the bituminous material as described in greater detail above. When a contacting step 600, 610, or 620 includes passing one of the wash materials through the bituminous material, the bituminous material becomes wet with whichever of the wash materials is passed through the bituminous material. For example, when bituminous material is contacted with first solvent by passing the first solvent through the bituminous material, a portion of the first solvent becomes trapped in the bituminous material, thereby making the bituminous material first solvent-wet bituminous material. When each of steps 600, 610, and 620 include passing the wash material through the bituminous material, the method is similar or identical to the method described above (i.e., the method including steps 500, 510, and 520).

Any or all of the contacting step 600, 610, and 620 can also include adding wash material to bituminous material and mixing the two components into a mixture or slurry. Mixing can differ from passing a wash material through the bituminous material in that a mixing step does not require the movement of wash material from one side of the bituminous material through to the opposite side of the bituminous material and the discharge of a relatively large portion of the wash material from the bituminous material. Rather, mixing generally includes a majority or all of the wash material remaining with the bituminous material in the form of a slurry and the two components being mixed together.

Any suitable manner of mixing first solvent, second solvent, or water with the bituminous material can be used to carry out step 600, 610, or 620. The mixing can occur by adding both the bituminous material and the wash material to a vessel and mixing the two components together to form a slurry of bituminous material that is wet with the specific wash material used in the contacting step. Mixing together the wash material and the bituminous material can provide desirable results. For example, when first solvent is mixed with bituminous material, the mixing promotes the dissolution of bitumen from the bituminous material into the first solvent.

In embodiments where any of the contacting steps 600, 610, 620 include mixing wash material with the bituminous material, the contacting step can further include a step of separating out certain components from the resulting mixture. When step 600 includes mixing, the separation step will generally include separating a bitumen-enriched first solvent phase from first solvent-wet bituminous material. When step 610 includes mixing, the separation step will generally include separating a mixture of first solvent and second solvent from the second solvent-wet bituminous material. When step 620 includes mixing, the separation step will generally include separating a mixture of second solvent and water from the bituminous material. Any suitable separation methods can be used to carry out the above-described separations. Exemplary separation methods can include any of those described in previous embodiments, including but not limited to, filtering, settling and decanting, gravity or gas overpressure drainage, and displacement washing.

In some embodiments, one or more of the separation steps described above are carried out in a hydrocyclone. Generally speaking, the mixture formed in step 600, 610, or 620 is transported into a hydrocyclone where the hydrocyclone acts to separate the mixture into an overflow and an underflow. When the mixture formed in step 600 is separated in a hydrocyclone, the mixture will be separated into a bitumen-enriched first solvent overflow and a first solvent-wet bituminous material underflow. When the mixture formed in step 610 is separated in a hydrocyclone, the mixture will be separated into a first solvent and second solvent mixture overflow and a second solvent-wet bituminous material underflow. When the mixture formed in step 620 is separated in a hydrocyclone, the mixture will be separated into a second solvent and water mixture overflow and a water-wet bituminous material underflow.

Any suitable hydrocyclone can be used to carry out the separation process. Typical hydrocyclones suitable for use in the above described method include hydrocyclone separators that utilize centrifugal forces to separate materials of different density, size, and/or shape. The hydrocyclone will typically include a stationary vessel having an upper cylindrical section narrowing to form a conical base. The mixtures are introduced into the hydrocyclone at a direction generally perpendicular to the axis of the hydrocyclone. This induces a spiral rotation on the mixture inside the hydrocyclone and enhances the radial acceleration on the solids within the mixture. The hydrocyclone also typically includes two outlets. The underflow outlet is situated at the apex of the cone, and the overflow outlet is an axial tube rising to the vessel top (sometimes also called the vortex finder).

When the density of the solids is greater than that of the fluid portion of the mixture, the heavier solid particles migrate quickly towards the cone wall where the flow is directed downwards. Lower density solid particles migrate more slowly and therefore may be captured in the upward spiral flow and exit from vortex finder via the low pressure center. Factors affecting the separation efficiency include fluid velocity, density, and viscosity, as well as the mass, size, and density of the tailings particles. The geometric configuration of the hydrocyclone can also play a role in separation efficiency. Parameters that can be varied to adjust separation efficiency include cyclone diameter, inlet width and height, overflow diameter, position of the vortex finder, height of the cylindrical chamber, total height of the hydrocyclone, and underflow diameter.

A separate hydrocyclone can be provided to carry out each of the separation steps that occur after the contacting (i.e., mixing) steps 600, 610, 620, or a single hydrocyclone can be used for one or more separations. In embodiments, where a separate hydrocyclone is provided for each separation, a first hydrocyclone receives and separates the first mixture formed in step 600, a second hydrocyclone receives and separates the second mixture formed in step 610, and a third hydrocyclone receives and separates the third mixture formed in step 620. Each of the hydrocyclones can be sized and configured especially for the separation for which it is used. When each separation step is carried out in a separate hydrocyclone, the process can generally proceed as follows. A bituminous material and a first solvent are contacted so as to form a first mixture. The first mixture is delivered into the first hydrocyclone and separated into a bitumen-enriched first solvent overflow and a first solvent-wet bituminous material underflow. The underflow is contacted with second solvent so as to form a second mixture. The second mixture is delivered into the second hydrocyclone and separated into a bitumen-enriched second solvent overflow and a second solvent-wet bituminous material underflow. The underflow is contacted with water so as to form a third mixture. The third mixture is delivered into the third hydrocyclone and separated into a mixture of first solvent and second solvent overflow and a water-wet bituminous material underflow.

As noted above, each separation step does not require its own hydrocylone. In some embodiments, each separation step can be carried out in the same hydrocyclone. Alternatively, two separation steps can take place in one hydrocyclone and a second hydrocyclone can be provided for the third separation step. Thus, for example, a first hydrocyclone can separate the first mixture into a bitumen-enriched first solvent overflow and a first solvent-wet bituminous material underflow, the underflow can be contacted with second solvent so as to form a second mixture, and the second mixture can be delivered into the same hydrocyclone to separate the second mixture into a bitumen-enriched second solvent overflow and a second solvent-wet bituminous material underflow. A third hydrocyclone can then be used to separate the third mixture formed from the mixture of second solvent-wet bituminous material and water.

In some embodiments, each separation step can include multiple stages such that the mixture is passed through the hydrocyclone multiple times before being passed through to the next hydrocyclone. For example, the first mixture of bituminous material and first solvent can be passed through a hydrocyclone a first time, followed by collecting the first solvent-wet bituminous material overflow, adding an additional quantity of first solvent, and passing the resulting mixture through the same hydrocyclone. This can be repeated numerous times to increase the separation efficiency. In the case of the third separation step, multiple passes through the hydrocyclone may be necessary to effect a suitable separation of second solvent from the water-wet bituminous material because of the immiscibility between the second solvent (i.e. paraffinic solvent) and the water.

When solvent is added to a stream separated by the hydrocyclone, such as in the case of adding additional first solvent to the first-solvent wet bituminous material overflow described above, the additional solvent can be obtained from a downstream hydrocyclone separation. In this manner, the solvent flows counter current to the solids for multiple washes and more efficient bitumen extraction with higher bitumen loading into the solvent is obtained with each subsequent hydrocyclone stage.

Any bitumen recovered from the above-described methods, such as the bitumen content of the bitumen-enriched solvent phases, can also undergo any type of upgrading processing known to those of ordinary skill in the art. Upgrading of the bitumen can comprise any processing that generally produces a stable liquid (i.e., synthetic crude oil) and any subsequent refinement of synthetic crude oil into petroleum products. The process of upgrading bitumen to synthetic crude oil can include any processes known to those of ordinary skill in the art, such as heating or cracking the bitumen to produce synthetic crude. The process of refining synthetic crude can also include any processes known to those of ordinary skill in the art, such as distillation, hydrocracking, hydrotreating, and coking. The petroleum products produced by the upgrading process are not limited, any may include petroleum, diesel fuel, asphalt base, heating oil, kerosene, and liquefied petroleum gas.

EXAMPLES

Example 1

Semi-Continuous Countercurrent Washing Using a Horizontal Filter Press

A first bitumen extraction experiment was conducted using a filter press 21.1 kg of oil sand ore having a bitumen content of 13.5 wt % was mixed with 5.9 kg of disbit solvent containing 1.4 kg of bitumen and 4.5 kg of Aromatic 150. The disbit solvent to bitumen ratio was about 1:2.1. The disbit solvent and oil sand ore were mixed for 10 minutes in a disaggregation device.

The ore/solvent mixture was removed from the disaggregation device and pumped to the filter press. The filter press was filled through a fill orifice until pressure reached a maximum. The filter press was pressurized with an inert gas and the bitumen-enriched solvent phase collected at the outlet of the filter press. The bitumen-enriched solvent phase weighed 5.4 kg, including 2.6 kg of bitumen and 2.8 kg of disbit solvent. Disbit-wet tailings remained in the filter press. The bitumen recovery for this initial step amounted to 62%.

A fresh solution of Aromatic 150 was pumped into the filter press at a solvent to original bitumen weight ratio of 1.1:1. The filter press was pressurized with inert atmosphere and the fresh Aromatic 150 was forced through the disbit-wet tailings in a plug flow 'washing' action. The secondary bitumen-enriched solvent phase was collected at the outlet of the plate and frame filter press. The secondary bitumen-enriched solvent phase weighed 5.8 kg, including 1.2 kg of bitumen and 4.6 kg of Aromatic 150. The solvent-wet tailings remained in the plate and frame filter press. The bitumen recovery for this second step amounted to 29%. The bitumen recovery for the first and second step combined was therefore 95%.

The solvent-wet tailings remaining in the filter press were cleaned of residual Aromatic 150 and any remaining bitumen using a secondary lighter solvent of methanol. The fresh solution of secondary solvent was pumped into the filter press across the solvent-wet tailings at a secondary solvent to original bitumen weight ratio of 2.2:1. The filter press was pressurized with inert atmosphere while 10.1 kg of the Aromatic 150-methanol mixture was collected at the outlet of the filter. The Aromatic 150-methanol mixture included 0.3 kg of bitumen, 1.8 kg of Aromatic 150 and 8.0 kg of methanol. The Aromatic 150-methanol mixture was sent to an evaporation separation process to recycle the secondary solvent. The second solvent-wet tailings remaining in the filter press included 0.2 kg bitumen and 8 kg of secondary solvent. The bitumen recovery of the entire process amounted to 98%.

Room temperature water was injected into the second solvent-wet tailings loaded in the filter press to remove the residual secondary solvent and produce final solvent-dry, stackable tailings. The solvent-dry, stackable tailings had a total weight of 20.8 kg, including 0.07 kg bitumen, 0.17 kg Aromatic 150, and 0.1 kg secondary solvent.

Table 1 summarizes the measurements taken of various samples throughout the experiment.

TABLE 1

Mass Balance for Solvent Extraction of Bitumen in a Filter Press Apparatus (all values in kg)

| | Mass | | Bitumen | | S150 | | MeOH | | Solids | | Water | | Hydrocarbon | |
|---|---|---|---|---|---|---|---|---|---|---|---|---|---|---|
| PP22MF | In | Out | In | Out | In | Out | In | Out | In | Out | In | Out | In | Out |
| Slurry Fill | | | | | | | | | | | | | | |
| Feed to Press | 27.05 | | 4.27 | | 4.51 | | | | 17.74 | | 0.53 | | 8.78 | |
| Primary Disbit | | 5.38 | | 2.64 | | 2.74 | | | | | | | | 5.38 |
| Secondary Leach | | | | | | | | | | | | | | |
| (Feed to 2nd stage leach) | 21.68 | | 1.64 | | 1.77 | | | | | | | | | |
| Second Solvent Addition | 4.70 | | | | 4.70 | | | | | | | | 4.70 | |
| Secondary Disbit | | 5.78 | | 1.23 | | 4.55 | | | | | | | | 5.78 |
| MeOH Wash | | | | | | | | | | | | | | |
| (Feed to Wash stage) | 20.60 | | 0.41 | | 1.92 | | | | | | | | | |
| Wash Solvent Addition | 9.40 | | | | | | 9.40 | | | | | | | |
| Final Wash Product | | 10.14 | | 0.34 | | 1.81 | | 8.00 | | | | | | 2.14 |
| Water Wash | | | | | | | | | | | | | | |
| (Feed to water wash) | 19.86 | | | | | | | | | | | | | |
| Water Addition | 7.80 | | | | | | | | | | 7.80 | | | |
| Wash Product | | 6.85 | | NA | | NA | | NA | | | | 6.85 | | |

TABLE 1-continued

Mass Balance for Solvent Extraction of Bitumen in a Filter Press Apparatus (all values in kg)

| | Mass | | Bitumen | | S150 | | MeOH | | Solids | | Water | | Hydrocarbon | |
|---|---|---|---|---|---|---|---|---|---|---|---|---|---|---|
| PP22MF | In | Out | In | Out | In | Out | In | Out | In | Out | In | Out | In | Out |
| Tailings | | | | | | | | | | | | | | |
| (Feed to Tailings) | 20.81 | | 0.07 | | 0.12 | | | | | | | | | |
| Tailings | | 20.25 | | 0.07 | | | | | | 17.61 | | 2.57 | | 0.07 |
| Recovery | | | | | | | | | | | | | | |
| Primary Disbit | | | 61.7% | | 29.7% | | | | | | | | | |
| Secondary Disbit | | | 28.8% | | 49.4% | | | | | | | | | |
| MeOH Wash | | | 7.8% | | 19.6% | | 85.1% | | | | | | | |
| Tailings | | | | | | | | | | | | | | |
| Total Recovery | | | 98.3% | | 98.7% | | 85.1% | | 99.3% | | 113.1% | | 98.6% | |

Example 2

Semi-Continuous Countercurrent Washing Using a Horizontal Filter Press

A second bitumen extraction experiment was conducted in the same manner as described above in Example 1, with the exception that a PneumaPress®-type horizontal pressure filter was used to carry out the experiment. The results of the second bitumen extraction experiment are summarized below in Table 2.

Example 3

Semi-Continuous Countercurrent Washing Using a Vertical Column in Down Flow Mode Two trials of a third bitumen extraction experiment were carried out in a 3 inch diameter by 3 feet vertical column fitted with flanges on the top and bottom of the column. The bottom flange had a ½" solvent outlet port and was covered with a 120 mesh metal screen. The top flange had a solvent inlet port, pressure relief valve, and nitrogen inlet to control the pressure applied to the headspace in the column.

TABLE 2

Mass Balance for Solvent Extraction of Bitumen in a Filter Press Apparatus (all values in kg)

| | Mass | | Bitumen | | S150 | | MeOH | | Solids | | Water | | Hydrocarbon | |
|---|---|---|---|---|---|---|---|---|---|---|---|---|---|---|
| PP25 | In | Out | In | Out | In | Out | In | Out | In | Out | In | Out | In | Out |
| Slurry Fill | | | | | | | | | | | | | | |
| Feed to Press | 25.40 | | 3.7116 | | 4.13 | | | | 17.06 | | 0.50 | | 7.84 | |
| Primary Disbit | | 4.38 | | 1.9777 | | 2.40 | | | | | | | | 4.38 |
| Secondary Leach | | | | | | | | | | | | | | |
| (Feed to 2nd stage leach) | 21.03 | | 1.73 | | 1.73 | | | | | | | | | |
| Second Solvent Addition | 4.20 | | | | 4.20 | | | | | | | | 4.20 | |
| Secondary Disbit | | 5.10 | | 0.76 | | 4.34 | | | | | | | | 5.10 |
| MeOH Wash | | | | | | | | | | | | | | |
| (Feed to Wash stage) | 20.13 | | 0.98 | | 1.59 | | | | | | | | | |
| Wash Solvent Addition | 5.70 | | | | | | 5.70 | | | | | | | |
| Final Wash Product | | 6.49 | | 0.11 | | 0.63 | | 5.75 | | | | | | 0.74 |
| Water Wash | | | | | | | | | | | | | | |
| (Feed to water wash) | 19.34 | | | | | | | | | | | | | |
| Water Addition | 7.15 | | | | | | | | | | 7.15 | | | |
| Wash Product | | 6.85 | | NA | | NA | | NA | | | | 6.85 | | |
| Tailings | | | | | | | | | | | | | | |
| (Feed to Tailings) | 19.65 | | 0.87 | | 0.96 | | | | | | | | | |
| Tailings | | 19.70 | | 0.50 | | | | | | 16.90 | | 2.30 | | 0.50 |
| Recovery | | | | | | | | | | | | | | |
| Primary Disbit | | | 53.3% | | 28.8% | | | | | | | | | |
| Secondary Disbit | | | 20.4% | | 52.1% | | | | | | | | | |
| MeOH Wash | | | 2.9% | | 7.6% | | 100.9% | | | | | | | |
| Tailings | | | | | | | | | | | | | | |
| Total Recovery | | | 76.6% | | 88.5% | | 100.9% | | 99.1% | | 119.6% | | 84.8% | |

In each trial, Athabasca oil sand ore containing about 14% bitumen was dry screened to provide pieces of ore having a size of ¼" or less. The ore was forced through the screen leaving only residual clay balls and rocks behind. The screened ore was disaggregated with recycled secondary disbit (Aromatic 150 and bitumen) in a Lightning Lab Master Mixer using the A320 down pumping blade.

The slurry produced from the disaggregation step was loaded into the column by hand. After the slurry was loaded in the column, an initial nitrogen purge was used to drive out an initial quantity of disbit. Primary wash solvent of Aromatic 150 was then pumped into the top of the column, followed by a second nitrogen purge to displace the wash solvent. A secondary wash solvent of methanol was added to the top of the column followed by a third nitrogen purge.

The final wash consisted of adding room temperature water to the column followed by a final nitrogen purge. The nitrogen pressure was held constant at a pressure of 20 psig. Samples were taken of the first three products and analyzed for Aromatic 150, methanol, and bitumen content, where applicable. The tailings were dried in an oven at 100° C. to drive off residual moisture/solvent and analyzed for recoverable bitumen content in a Dean-Stark apparatus.

The mass balances for the two trials are shown in the Tables 3 and 4 below. While it is noted that the methanol recoveries are relatively low, this can likely be attributed to the greater than 100% recovery in the water wash processing step, as some methanol is co-recovered by the water wash.

TABLE 3

Mass Balance Data for First Trial (all values in kg except for percentages)

| Test No.: M18 | Mass | Bitumen | S150 | MeOH | Sand | Water | Hydrocarbon |
|---|---|---|---|---|---|---|---|
| Feed | 6.87 | 1.02 | 1.03 | 0.00 | 4.68 | 0.14 | 2.05 |
| Primary Disbit | 0.98 | 0.48 | 0.50 | 0.00 | 0.00 | 0.00 | 0.98 |
| Secondary Disbit | 1.82 | 0.51 | 1.31 | 0.00 | 0.00 | 0.00 | 1.82 |
| Wash | 1.68 | 0.03 | 0.32 | 1.33 | 0.00 | | 0.35 |
| Tailings | 5.15 | 0.01 | NA | NA | 4.57 | 0.57 | 0.01 |
| Recovery in: | | | | | | | |
| Primary Disbit | | 47.0% | 23.3% | | | | |
| Secondary Disbit | | 50.0% | 60.0% | | | | |
| MeOH Wash | | 3.3% | 14.5% | 85.0% | | | |
| Water Wash | | | | | | 106.0% | |
| Tailings | | 0.6% | NA | 0.0% | | | |
| Total Recovery | | 100.3% | 97.69% | 85.0% | | | 98.4% |

TABLE 4

Mass Balance Data for Second Trial (all values in kg except percentages)

| Test No.: M24 | Mass | Bitumen | S150 | MeOH | Sand | Water | Hydrocarbon |
|---|---|---|---|---|---|---|---|
| Feed | 6.50 | 0.89 | 0.77 | 0.00 | 4.70 | 0.14 | 1.66 |
| Primary Disbit | 0.66 | 0.40 | 0.27 | 0.00 | 0.00 | 0.00 | 0.66 |
| Secondary Disbit | 1.31 | 0.40 | 0.91 | 0.00 | 0.00 | 0.00 | 1.31 |
| Wash | 1.45 | 0.00 | 0.35 | 0.96 | 0.00 | | 0.35 |
| Tailings | 5.37 | 0.09 | NA | NA | 4.57 | 0.70 | 0.09 |
| Recovery in: | | | | | | | |
| Primary Disbit | | 44.2% | 15.6% | | | | |
| Secondary Disbit | | 44.3% | 52.9% | | | | |
| MeOH Wash | | 0.2% | 20.1% | 87.3% | | | |
| Water Wash | | | | | | 107.4% | |
| Tailings | | 10.5% | NA | 0.0% | | | |
| Total Recovery | | 88.8% | 88.6% | 87.3% | | | 88.7% |

Example 4

Semi-Continuous Countercurrent Washing Using a Vertical Column in Up Flow Mode

To evaluate the difference between a down flow and an up flow column system, a single test was carried out whereby the Aromatic 150 was fed through the bitumen containing material in an up flow mode.

The column used for the bitumen extraction process was a 6" internal diameter by 6' tall Schedule 10 steel pipe. The column included flanges at the top and bottom of the column. The flange on the bottom of the pipe had a ½" port which was used for solvent inlet and outlet. The bottom flange was covered with a 120 mesh screen. The top flange had three ½" ports which were used for the wash solvent inlet, nitrogen inlet, and pressure relief valve.

10 kg of clean sand was placed in the column on top of a 120 mesh screen. 30 kg of ore with a bitumen content of 12.5% was placed in the column on top of the clean sand. Aromatic 150 was introduced to the column through the inlet on the bottom flange in an up flow mode at a rate of 0.67 liters per minute. This amounted to a 4:1 Aromatic 150 to bitumen ratio by volume. Nitrogen at a pressure of 20 psig was added to the top of the column until dissolved bitumen in Aromatic 150 was driven out of the column. The dissolved bitumen in Aromatic 150 was collected and then pumped back into the column again through the bottom inlet at a rate of 0.67 liters per minute. This process was repeated three times. After a nitrogen displacement, methanol at a 2:1 methanol to bitumen ratio by mass was introduced to the column through the inlet in the top flange at a rate of 1.33 liters per minute. 20 psig of nitrogen was again added to the top of the column to drive out any remaining dissolved bitumen in Aromatic 150 as well as the methanol. The residual dissolved bitumen plus Aromatic 150 phase was displaced with methanol and this combined residual bitumen-Aromatic 150-methanol mixture was pumped back into the top of the column at a rate of 1.33 liters per minute. After washing completion, the residual bitumen-Aromatic 150-methanol mixture was again driven out with 20 psig of nitrogen. This methanol washing procedure was repeated once. After a nitrogen displacement, room temperature water at a 3:1 water to bitumen ratio by volume was introduced to the column through the inlet in the top flange at a rate of 3 liters per minute. A final nitrogen displacement at 20 psig was used to drive out the water and residual methanol. The tailings were analyzed for bitumen and assayed 1.27% bitumen. The residual methanol content of the tailings were analyzed and determined to be 85 ppm.

The mass balance for this test run is shown in Table 5.

TABLE 5

Mass Balance Data for Example 4

| DSX-388 | Mass (kg) | Bitumen (kg) | Solvent 150 (kg) | MeOH (kg) | Water (kg) | Hydrocarbon (kg) | Bitumen Recovery Stage | Bitumen Recovery Cumulative |
|---|---|---|---|---|---|---|---|---|
| Feed | 40.0 | 4.9 | 14.1 | | | 26.1 | | |
| First Purge | 13.0 | 3.0 | 10.0 | 0.0 | 0.0 | 13.0 | 61.6% | 61.6% |
| Second Purge | 8.3 | 1.2 | 4.0 | 3.2 | 0.0 | 1.2 | 24.0% | 85.7% |
| Third Purge | 30.2 | 0.0 | 0.0 | 3.9 | 25.5 | 29.4 | | |
| Tailings | | 0.5 | 0.0 | 0.0 | 4.6 | 3.4 | | |
| Total Added | | | | 7.1 | 30.2 | | | |
| Recovery | | 85.7% | 99.2% | 99.2% | 84.7% | 90.8% | | |

Example 5

Semi-Continuous Countercurrent Washing Using a Vertical Column Using Different Wash Water Temperatures The procedure outlined in Example was performed twice, with the exception of using a down flow mode and the use of water having a temperature below (45° C.) and above (75° C.) the boiling point of methanol (65° C.) for the water wash step, as opposed to the use of water at room temperature.

A complete mass balance for the 45° C. water trial is shown in Table 6.

TABLE 6

Mass Balance for Example 5 (45° C. Water Wash)

| DSX-516 | Mass (kg) | Bitumen (kg) | Solvent 150 (kg) | MeOH (kg) | Water (kg) | Hydrocarbon (kg) | Bitumen Recovery Stage | Bitumen Recovery Cumulative |
|---|---|---|---|---|---|---|---|---|
| Feed | 13.0 | 1.6 | 3.5 | | | 5.1 | | |
| First Purge | 3.4 | 1.1 | 2.3 | 0.0 | 0.0 | 3.4 | 68.2% | 68.2% |
| Second Purge | 2.6 | 0.1 | 1.1 | 1.4 | 0.0 | 1.3 | 8.8% | 77.0% |
| Third Purge | 0.0 | 0.0 | 0.0 | 1.0 | 1.6 | 0.0 | 0.0% | 77.0% |
| Tailings | 0.0 | 0.0 | 0.0 | 0.0 | 1.3 | 0.0 | | |
| Oversize | 0.000 | 0.30 | 0.00 | 0 | 0 | 0.3 | | |
| Total Added | | | | 2.4 | 3.1 | | | |
| Recovery | | 77.0% | 98.5% | 100.4% | 50.5% | 91.7% | | |

The methanol content of the final washed tails assayed 11,976 ppm MeOH.

A complete mass balance for the 75° C. water trial is shown in Table 7

TABLE 7

Mass Balance for Example 5 (75° C. Water Wash)

| DSX-518 | Mass (kg) | Bitumen (kg) | Solvent 150 (kg) | MeOH (kg) | Water (kg) | Hydrocarbon (kg) | Bitumen Recovery Stage | Bitumen Recovery Cumulative |
|---|---|---|---|---|---|---|---|---|
| Feed | 13.0 | 1.6 | 3.6 | | | 5.3 | | |
| First Purge | 3.6 | 1.2 | 2.4 | 0.0 | 0.0 | 3.6 | 72.0% | 72.0% |
| Second Purge | 2.6 | 0.1 | 0.7 | 1.5 | 0.0 | 0.8 | 5.6% | 77.7% |
| Third Purge | 0.0 | 0.0 | 0.1 | 0.9 | 1.6 | 0.1 | 0.0% | 77.7% |
| Tailings | 0.0 | 0.0 | 0.0 | 0.0 | 1.4 | 0.0 | | |
| Oversize | 0.000 | 0.33 | 0.00 | 0 | 0 | 0.3 | | |
| Total Added | | | | 2.4 | 3.0 | | | |
| Recovery | | 77.7% | 90.9% | 99.8% | 52.0% | 86.8% | | |

The methanol content of the final washed tails assayed 396 ppm MeOH.

Comparison of the final tails methanol assays for the two trials demonstrated that low levels of final solvent in the tails can be produced.

Example 6

The effect of the presence of water in an aromatic solvent-polar solvent system was investigated. Aromatic 150 was selected as the aromatic organic phase and methanol was selected as the polar solvent. Five aliquots of 250 cc total organic liquid were prepared each containing different volume percentages of Aromatic 150 and methanol.

| Initial volume Centiliter | Aromatic Vol-% | Methanol Vol-% | Water addition needed for organic separation Centiliter | Calculated water in methanol Vol % |
|---|---|---|---|---|
| 250 | 90 | 10 | 1.5 | 6 |
| 250 | 75 | 25 | 1.5 | 2.4 |
| 250 | 50 | 50 | 10 | 8 |
| 250 | 50* | 50 | 15 | 12 |
| 250 | 25 | 75 | 15 | 8 |
| 250 | 10 | 90 | 5 | 2.2 |

*Aromatic 150 was replaced by a light aromatic distillate (~200 deg C.)

When the two organic phases were initially mixed, all five sample phases were totally miscible and no separation of phases occurred. Then water was added to each sample and the required volume of water needed to produce an immiscible system was measured. It should be noted that the water phase completely dissolved into the methanol phase. Hence only two phases were noticed. This experiment confirmed that water acts as an antisolvent or a "salting out" agent for a mixed aromatic-polar solvent system.

One test was carried out using a light distillate that was derived from a hydrocarbon cracking process as defined in U.S. patent application Ser. No. 12/509,298. Since methanol has a lower density (~0.8 g/cc) then Aromatic 150 (~0.9 g/cc), the methanol will separate as the top layer and the Aromatic 150 will settle down as the bottom layer.

Two other findings were made. Firstly, if more than the minimum amount of water necessary to separate the aromatic-polar solvent system is added, the density of the methanol/water phase increases until it ultimately reaches a density that is higher than the Aromatic 150 phase. As a result, an inversion takes place. Secondly, the test, procedures also demonstrated that if any Aromatic 150-methanol miscible mixture that was left standing for enough time and exposed to the air, the mixture became unstable due to the absorption of moisture from the air. Brownian movements of separated phases in the miscible phase were clearly visible.

First solvent-wet tailings that have undergone bitumen-enriched solvent phase separation through the addition of first solvent may include about 12% first solvent (e.g., Aromatic 150, which may include minor amounts of bitumen dissolved therein). The volume ratio of first solvent to, polar solvent used to wash first solvent-wet tailings of first solvent can range from about 1 to as much as 4. Every kg of tar sand wills produce a first solvent-wet tailings containing about 120 grams of first solvent. Therefore, the amount of polar solvent used for each kg of tar sand ranges 120 to 480 ccs of polar solvent. Athabasca tar sands have a moisture content ranging from about 2 to 10 wt-%. Hence for every kg of tar sands added to the process, there will be between 20 and 100 grams of water. To produce immiscible phases of first solvent and polar solvent, one requires at least 8 vol-% of water in methanol as shown in the Table above. This translates into 9.6 to 38.4 grams of water per kg of tar sand. This range should be compared to the water content originally present in tar sands (ranging from 20 to 100 gram per kg tar sand). Thus, on average the tar sand itself should provide most of the water necessary to facilitate the phase disengagement between the first solvent and the polar solvent.

The above conditions were calculated for the overall process configuration, but it should be realized that the initial flow of polar solvent will not have access to the full amount of available water that should be present in the first solvent-wet tailings. Consequently, as the polar solvent is contacted with the first solvent wet tailings, there will be a gradual increase in the water to polar solvent ratio and there will therefore be a change in the miscibility as the polar solvent travels through the first solvent wet tailings. Thus, the process can be manipulated to create single or distinct phases where desirable through manipulation of the water content. It should be further noted that this phenomenon of salting out two miscible organic phases by water addition is not limited to Aromatic 150 and methanol. When Aromatic 150 was replaced by a light distillate (as shown in above table) the same phenomenon was observed, albeit at an increased amount of water needed. Similar phenomenon were seen where alternative alcohols (e.g., ethanol, butanol, propanol) were used in place of methanol.

Example 7

Bitumen Extraction Process Using Parrafinic Solvent in Vertical Column 200 kg of mined oil sands having 11.5 wt % bitumen content was mixed in a drum with 32.5 kg of disbit. The mixed product was allowed to settle and the excess liquid decanted off and the remaining solids placed in a vertical cylindrical column having a height of 8 feet and a diameter of 12 inches. A mass of 25.7 kg of Aromatic 100 was added to the top of the vertical column on top of the solids and the top of the vertical column was then sealed and a nitrogen inert gas purge was conducted to drive trapped first solvent down and out of the vertical column. 60 psig of inert gas was introduced into the top of the vertical column, and the material driven out of the bottom of the column by the gas purge contained 29 kg first solvent and 25 kg bitumen.

43 kg of pentane was added to the top of the vertical column and allowed to flow down through the interstitial pores in the material loaded in the vertical column. The top of the vertical column was then sealed and a nitrogen purge was conducted to drive trapped first solvent down and out of the vertical column. 60 psig of inert gas was introduced into the top of the vertical column, and the material driven out of the bottom of the column by the gas purge contained 6 kg first solvent, 30 kg second solvent, and 4 kg bitumen.

54 kg of water was added to the top of the vertical column and allowed to flow down through the interstitial pores in the material loaded in the vertical column. The top of the vertical column was then sealed and a nitrogen purge was conducted to drive trapped first solvent down and out of the vertical column. 60 psig of inert gas was introduced into the top of the vertical column, and the material driven out of the bottom of the column by the gas purge contained 0.1 kg first solvent, 31 kg second solvent, 20 kg water and 0.1 kg bitumen. The remaining portion of the water remained in the material loaded in the vertical column.

The material loaded in the vertical column was discharged from the bottom of the vertical column. The majority of the material was inert solid material, such as sand and clay. The material also included 250 ppm first solvent, 450 ppm second solvent, 36 kg water, and 0.2 kg bitumen.

Example 8

Bitumen Extraction Process Using Paraffinic Solvent and Hydrocyclones

A slurry of oil sands and solvent is prepared. The slurry is prepared by mixing 22.5 t/hr of mined oil sands containing 11.5% bitumen with 2.7 t/hr of Aromatic 150. The slurry is introduced into a KREBS D6BGMAX hydrocyclone of 6" diameter and the hydrocyclone operates to separate the slurry into a first disbit stream that leaves the hydrocyclone from the overflow and a tailings stream that leaves the hydrocylone from the underflow. The disbit overflow leaving the hydrocyclone includes a mixture of first solvent and bitumen with some solids. The overflow mixture includes 53.2% first solvent and 20.8% bitumen and 26% solids. The underflow leaving the hydrocylone includes inert solid material, such as sand and clay, bitumen, and first solvent. The underflow mixture includes 70% inert material, 18% first solvent, 5% water and 7.0% bitumen.

The underflow mixture is mixed with pentane to create a second slurry. 11.9 t/hr of pentane is mixed with the underflow mixture to form the second slurry. The second slurry is introduced into a KREBS D6BGMAX hydrocyclone of 6" diameter and the hydrocyclone operates to separate the slurry into a first disbit stream that leaves the hydrocyclone from the overflow and a tailings stream that leaves the hydrocylone from the underflow. The overflow leaving the hydrocyclone includes a mixture of first solvent, second solvent, and bitumen. The overflow mixture is produced at a rate of 11.7 t/hr and includes 29% Aromatic 150 and 71% pentane. The underflow leaving the hydrocyclone includes inert solid material, bitumen, first solvent, and second solvent. The underflow mixture includes 72% inert material, 1% first solvent, 20% second solvent, 5% water and 0.7% bitumen.

The underflow mixture is mixed with water to create a third slurry. 12 t/hr of water is mixed with the underflow to form the third slurry. The third slurry is introduced into a KREBS D6BGMAX hydrocyclone of 6" diameter and the hydrocyclone operates to separate the slurry into a first disbit stream that leaves the hydrocyclone from the overflow and a tailings stream that leaves the hydrocylone from the underflow. The overflow leaving the hydrocyclone includes a mixture of first solvent, second solvent, water, and bitumen. The overflow mixture includes 2% first solvent, 37% second solvent, 60% water, and 0.4% bitumen. The underflow leaving the hydrocyclone includes inert solid material, bitumen, first solvent, second solvent, and water. The underflow mixture includes 70% inert material, 0.4% first solvent, 1% second solvent, 28% water, and 0.4% bitumen. Alternatively the water wash portion can be carried out in a vertical column as described in the water wash portion of Example 7.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope and spirit of these claims.

What is claimed is:

1. A method comprising:

passing a first solvent through a first quantity of bituminous material;

passing a second solvent through the first quantity of bituminous material; and thereafter passing liquid water through the first quantity of bituminous material wherein the water removes at least 95% of the second solvent by displacing the second solvent;

wherein the second solvent comprises a paraffinic solvent and wherein the first solvent is different from the second solvent.

2. The method as recited in claim 1, further comprising:

loading the first quantity of bituminous material into a sealed vessel prior to passing the first solvent, the second solvent, and the water through the first quantity of bituminous material.

3. The method as recited in claim 2, wherein the sealed vessel is a sealed vertical column having a top end and a bottom end opposite the top end.

4. The method as recited in claim 3, wherein passing the first solvent through the first quantity of bituminous material comprises:

adding the first solvent at the top end of the sealed vertical column;

introducing inert gas into the sealed vertical column at the top end of the sealed vertical column and pushing the first solvent down through the bituminous material loaded in the sealed vertical column; and collecting the first solvent exiting the bottom end of the sealed vertical column.

5. The method as recited in claim 4, wherein the first solvent exiting the bottom end of the vertical column comprises first solvent and bitumen.

6. The method as recited in claim 3, wherein passing the second solvent through the first quantity of bituminous material comprises:

adding the second solvent at the top end of the vertical column;

introducing inert gas into the vertical column at the top end of the vertical column and pushing the second solvent down through the bituminous material loaded in the vertical column; and collecting the second solvent exiting the bottom end of the vertical column.

7. The method as recited in claim 6, wherein the second solvent exiting the bottom end of the vertical column comprises second solvent and first solvent.

8. The method as recited in claim 7, wherein the second solvent exiting the bottom end of the vertical column further comprises bitumen.

9. The method as recited in claim 3, wherein passing the water through the first quantity of bituminous material comprises:

adding the water at a top end of the vertical column;

introducing inert gas into the vertical column at the top end of the vertical column and pushing the water down through the bituminous material loaded in the vertical column; and collecting residual second solvent exiting the bottom end of the vertical column.

10. The method as recited in claim 1, wherein the bituminous material comprises oil sand.

11. The method as recited in claim 1, wherein the bituminous material is solvent-wet.

12. The method as recited in claim 3, wherein the bituminous material loaded in the vertical column comprises a plurality of interstitial pores, and wherein the ratio of volume of water passed through the first quantity of bituminous to total volume of the plurality of interstitial pores is from 1:1 to 5:1.

13. The method as recited in claim 2, further comprising:

removing the first quantity of bituminous material from the sealed vessel after passing the water through the first quantity of bituminous material.

14. The method as recited in claim 13, wherein the bituminous material removed from the sealed vessel comprises less than 200 ppm on a weight basis of first solvent, less than 100 ppm on a weight basis of second solvent, and less than 2% by weight bitumen.

15. A method comprising:

mixing first solvent with bituminous material and forming a mixture;

separating the mixture into a bitumen-enriched solvent phase and a bitumen-depleted tailings phase;

passing second solvent through the bitumen-depleted tailings phase;

passing third solvent through the bitumen-depleted tailings phase; and thereafter passing liquid water through the bitumen-depleted tailings phase wherein the water removes at least 95% of the second solvent by displacing the second solvent;

wherein the third solvent comprises paraffinic solvent and wherein the second solvent is different from the third solvent.

16. The method as recited in claim 15, wherein the first solvent is the same solvent as the second solvent and the first solvent is an aromatic solvent.

17. A method comprising:

contacting a bituminous material with a first solvent and forming first solvent-wet bituminous material;

contacting the first solvent-wet bituminous material with a second solvent and forming second solvent-wet bituminous material; and thereafter contacting the second solvent-wet bituminous material with liquid water and forming a water-wet bituminous material wherein the water removes at least 95% of the second solvent by displacing the second solvent;

wherein the second solvent comprises a paraffinic solvent and wherein the first solvent is different from the second solvent.

18. The method as recited in claim 17, wherein contacting the bituminous material with the first solvent comprises:

mixing the bituminous material with the first solvent and forming the first solvent-wet bituminous material; and separating a bitumen-enriched first solvent phase from the first solvent-wet bituminous material using a hydrocyclone.

19. The method as recited in claim 17, wherein contacting the first solvent-wet bituminous material with the second solvent comprises:

mixing the first solvent-wet bituminous material with the second solvent and forming the second solvent-wet bituminous material; and separating a mixture of first solvent and second solvent from the second solvent-wet bituminous material using a hydrocyclone.

20. The method as recited in claim 17, wherein contacting the second solvent-wet bituminous material with the water comprises:

mixing the second solvent-wet bituminous material with water and forming the water-wet bituminous material; and separating a mixture of second solvent and water from the water-wet bituminous material using a hydrocyclone.

21. The method as recited in claim 1 wherein said second solvent is a polar solvent.

22. The method as recited in claim 21 wherein said polar solvent is an oxygenated hydrocarbon selected from the group consisting of alcohols, ketones, and ethers.

* * * * *